US010679545B2

(12) United States Patent
Fukai

(10) Patent No.: US 10,679,545 B2
(45) Date of Patent: Jun. 9, 2020

(54) OPERATION METHOD OF DISPLAY DEVICE

(71) Applicant: Semiconductor Energy Laboratory Co., Ltd., Atsugi-shi, Kanagawa-ken (JP)

(72) Inventor: Shuji Fukai, Atsugi (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 226 days.

(21) Appl. No.: 15/673,693

(22) Filed: Aug. 10, 2017

(65) Prior Publication Data

US 2018/0053459 A1 Feb. 22, 2018

(30) Foreign Application Priority Data

Aug. 17, 2016 (JP) ..... 2016-159795

(51) Int. Cl.
*G09G 3/20* (2006.01)
*G09G 3/36* (2006.01)

(52) U.S. Cl.
CPC ..... *G09G 3/2018* (2013.01); *G09G 3/2003* (2013.01); *G09G 3/3688* (2013.01);
(Continued)

(58) Field of Classification Search
None
See application file for complete search history.

(56) References Cited

U.S. PATENT DOCUMENTS 6,714,268 B2 3/2004 Wang et al.
7,038,641 B2 5/2006 Hirota et al.
(Continued)

FOREIGN PATENT DOCUMENTS

JP 2001-066593 A 3/2001
JP 2002-196702 A 7/2002
(Continued)

OTHER PUBLICATIONS

Shieh.H, "Transflective display by Hybrid OLED and LCD", LEOS 2005 (IEEE Lasers and Electro-Optics Society Annual Meeting) , Oct. 22, 2005, pp. 650-651, IEEE.
(Continued)

*Primary Examiner* — Amare Mengistu
*Assistant Examiner* — Sarvesh J Nadkarni
(74) *Attorney, Agent, or Firm* — Robinson Intellectual Property Law Office; Eric J. Robinson

(57) ABSTRACT

To provide a display device with high display quality, an eye-friendly display device, a display device with low power consumption, a display device with a reduced change in voltage written to a pixel, or a novel display device. In the display device, a first image signal in which one of grayscale levels of a first pixel and an adjacent second pixel is near white and the other is near black is written. The first image signal is compared with a second image signal. When the grayscale levels of the second image signal written to the first pixel and the second pixel are halftone, the second image signal is written an odd number of times greater than or equal to three times. When the grayscale levels of the second image signal written to the first pixel and the second pixel are near white or near black, the second image signal is written once. The interval between the writing of the first image signal and the writing of the second image signal is longer than or equal to 1 second and shorter than or equal to 10,000 hours.

6 Claims, 19 Drawing Sheets

(52) U.S. Cl.
CPC ..... *G09G 2300/0426* (2013.01); *G09G 2320/066* (2013.01); *G09G 2330/023* (2013.01)

(56) References Cited

U.S. PATENT DOCUMENTS

| | | | | |
|---|---|---|---|---|
| 7,084,936 | B2 | 8/2006 | Kato | |
| 7,102,704 | B2 | 9/2006 | Mitsui et al. | |
| 7,176,991 | B2 | 2/2007 | Mitsui et al. | |
| 7,239,361 | B2 | 7/2007 | Kato | |
| 7,248,235 | B2 | 7/2007 | Fujii et al. | |
| 7,385,654 | B2 | 6/2008 | Mitsui et al. | |
| 8,823,893 | B2 | 9/2014 | Yamazaki | |
| 8,854,286 | B2 | 10/2014 | Yamazaki et al. | |
| 9,244,323 | B2 | 1/2016 | Yamazaki | |
| 9,368,082 | B2 | 6/2016 | Yamazaki et al. | |
| 9,620,525 | B2 | 4/2017 | Yamazaki | |
| 2003/0201960 | A1 | 10/2003 | Fujieda | |
| 2006/0072047 | A1* | 4/2006 | Sekiguchi | G02F 1/1335 349/25 |
| 2008/0180618 | A1 | 7/2008 | Fujieda | |
| 2010/0002021 | A1* | 1/2010 | Hashimoto | G09G 3/2003 345/690 |
| 2010/0171905 | A1 | 7/2010 | Huang et al. | |
| 2011/0285759 | A1* | 11/2011 | Sakai | G09G 3/3648 345/690 |
| 2016/0232868 | A1 | 8/2016 | Yamazaki et al. | |
| 2017/0004788 | A1 | 1/2017 | Yamazaki et al. | |
| 2017/0039977 | A1 | 2/2017 | Yamazaki | |

FOREIGN PATENT DOCUMENTS

| | | | |
|---|---|---|---|
| JP | 2002-328630 | A | 11/2002 |
| JP | 2003-076302 | A | 3/2003 |
| JP | 2003-157026 | A | 5/2003 |
| JP | 2003-157029 | A | 5/2003 |
| JP | 2003-228304 | A | 8/2003 |
| JP | 2003-316295 | A | 11/2003 |
| JP | 2003-322850 | A | 11/2003 |
| JP | 2004-296162 | A | 10/2004 |
| JP | 2007-232882 | A | 9/2007 |
| JP | 4161574 | B2 | 10/2008 |
| JP | 2011-141522 | A | 7/2011 |
| JP | 2011-237760 | A | 11/2011 |
| JP | 2013-221965 | A | 10/2013 |
| WO | WO-2004-053819 | A | 6/2004 |

OTHER PUBLICATIONS

Lee.J et al., "High ambient-contrast-ratio display using tandem reflective liquid crystal display and organic light-emitting device", Optics Express, Nov. 14, 2005, vol. 13, No. 23, pp. 9431-9438.

S. Amano et al., "43.4: Low Power LC Display Using In—Ga—Zn-Oxide TFTs Based on Variable Frame Frequency", SID Digest '10 : SID International Symposium Digest of Technical Papers, 2010, pp. 626-629.

* cited by examiner

200

OPERATION METHOD OF DISPLAY DEVICE

BACKGROUND OF THE INVENTION

1. Field of the Invention

The present invention relates to a semiconductor device, a method for driving the semiconductor device, and the like. The present invention relates to a display device, a method for driving the display device, and the like.

Note that in this specification, a semiconductor device means a circuit having a semiconductor element (e.g., a transistor or a diode) and a device having the circuit. The semiconductor device also means any device that can function by utilizing semiconductor characteristics. Examples of the semiconductor device include an integrated circuit, a chip including an integrated circuit, a display device, a light-emitting device, a lighting device, and an electronic device.

2. Description of the Related Art

Low-power consumption is an added value of a liquid crystal display device. For example, it has been reported that a reduction in power consumption is achieved by reducing the frequency of data rewriting in a period during which a still image is displayed (see the following references).

REFERENCES

Patent Documents

[Patent Document 1] Japanese Published Patent Application No. 2011-141522

[Patent Document 2] Japanese Published Patent Application No. 2011-237760

Non-Patent Document

[Non-Patent Document 1] S. Amano et al., "Low Power LC Display Using In—Ga—Zn-Oxide TFTs Based On Variable Frame Frequency", SID International Symposium Digest of Technical Papers, 41 (2010), pp. 626-629

SUMMARY OF THE INVENTION

An object of one embodiment of the present invention is to provide a display device with excellent display quality. Another object of one embodiment of the present invention is to provide an eye-friendly display device. Another object of one embodiment of the present invention is to provide a display device with low power consumption. Another object of one embodiment of the present invention is to provide a display device with a reduced change in voltage written to a pixel. Another object of one embodiment of the present invention is to provide a novel display device.

Note that the descriptions of these objects do not disturb the existence of other objects. In one embodiment of the present invention, there is no need to achieve all the objects. Other objects will be apparent from and can be derived from the description of the specification, the drawings, the claims, and the like.

One embodiment of the present invention is an operation method of a display device including a comparison circuit and a first display portion including a first pixel and a second pixel adjacent to the first pixel. Grayscale levels of an image displayed on the first display portion are $C_X$ at maximum. A first image signal is written to the first display portion. A grayscale level of the first image signal written to one of the first pixel and the second pixel is higher than or equal to $0.8C_X$ and a grayscale level of the first image signal written to the other of the first pixel and the second pixel is lower than or equal to $0.2C_X$. The first image signal and a second image signal are compared with each other before the second image signal is written. The writing of the second image signal is performed once when the grayscale levels of the second image signal written to the first pixel and the second pixel are each $0.8C_X$ or higher, or $0.2C_X$ or lower. The writing of the second image signal is performed an odd number of times greater than or equal to three times when the grayscale levels of the second image signal written to the first pixel and the second pixel are each higher than $0.2C_X$ and lower than $0.8C_X$. An interval between the writing of the first image signal and the writing of the second image signal is longer than or equal to 1 second and shorter than or equal to 10,000 hours.

In the above mode, it is preferable that the first display portion include a first display element and the first display element include a liquid crystal element. In the above mode, it is preferable that the first display element be configured to express a grayscale level by utilizing light reflection, a second display portion be included, the second display portion include a pixel including a second display element, and the second display element be a light-emitting display element. In the above mode, it is preferable that the pixel included in the first display portion include a transistor and the transistor include a metal oxide in a channel formation region.

One embodiment of the present invention is an operation method of a display device including a first display portion, a source driver, and a source line. The first display portion includes a pixel including a first display element. A first image is displayed on the first display portion. Then, a second image is displayed on the first display portion. The second image is written to the first display portion an odd number of times greater than or equal to three times when one of the first image and the second image is image data including a letter and the other of the first image and the second image is not image data including a letter. The second image is written to the first display portion once when each of the first image and the second image is image data including a letter or is not image data including a letter. A first signal is supplied to the source line by the source driver. A polarity of the first signal in odd-numbered writing in the writing performed the odd number of times is opposite to a polarity of the first signal in even-numbered writing in the writing performed the odd number of times. The writing performed the odd number of times greater than or equal to three times is performed at a frequency of greater than or equal to 30 Hz and less than or equal to 240 Hz.

In the above mode, it is preferable that the first display element be configured to express a grayscale level by utilizing light reflection. In the above mode, it is preferable that the first display element include a liquid crystal element. In the above mode, it is preferable that the pixel include a transistor and the transistor include a metal oxide in a channel formation region.

According to one embodiment of the present invention, a display device with excellent display quality can be provided. According to one embodiment of the present invention, an eye-friendly display device can be provided. According to one embodiment of the present invention, a display device with low power consumption can be provided. According to one embodiment of the present invention, a display device with a reduced change in voltage written to a pixel can be provided. According to one embodiment of the present invention, a novel display device can be provided.

Note that the description of these effects does not preclude the existence of other effects. One embodiment of the present invention does not necessarily achieve all the effects listed above. Other effects will be apparent from and can be derived from the description of the specification, the drawings, the claims, and the like.

DETAILED DESCRIPTION OF THE INVENTION

Figure 1A:
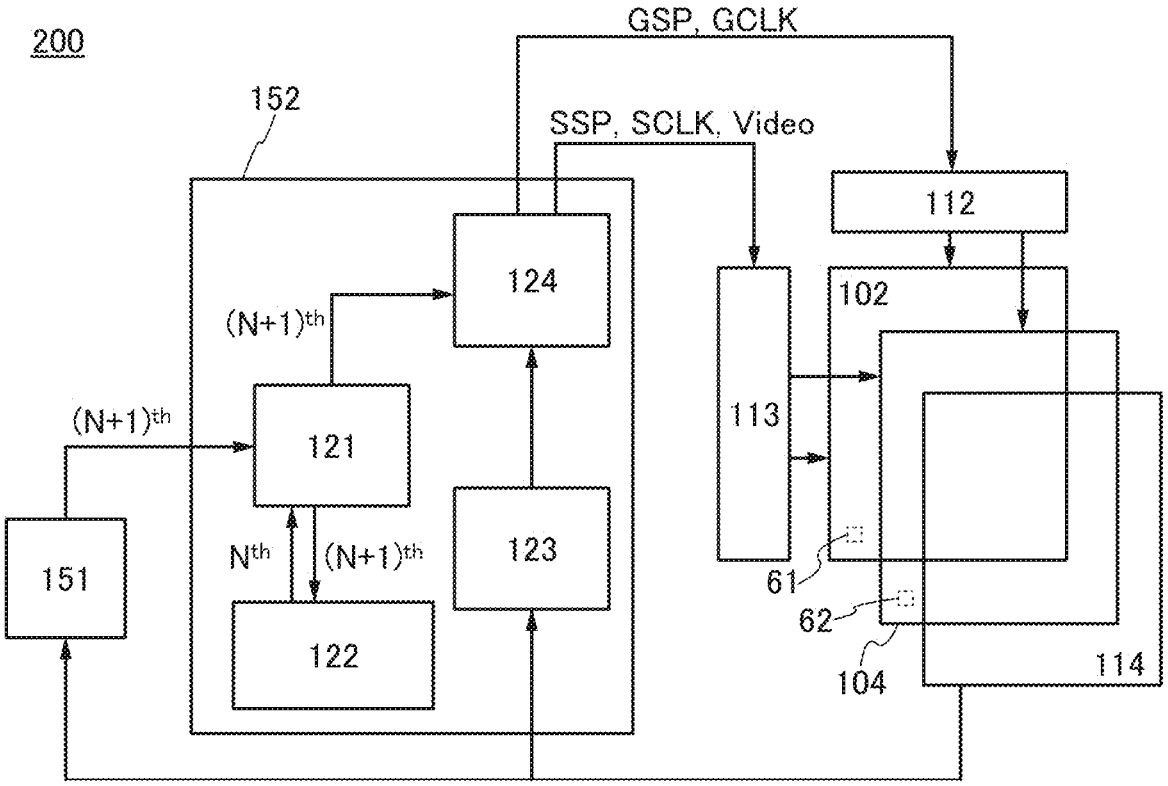
FIGS. 1A and 1B are block diagrams illustrating examples of a display device.

Hereinafter, embodiments of the present invention will be described in detail with reference to the accompanying drawings. However, the present invention is not limited to the following description and it is easily understood by those skilled in the art that the mode and details can be variously changed without departing from the scope and spirit of the present invention. Accordingly, the present invention should not be construed as being limited to the description of the embodiments below.

In this specification and the like, a semiconductor device refers to a device that utilizes semiconductor characteristics, and means a circuit including a semiconductor element (e.g., a transistor or a diode), a device including the circuit, and the like. The semiconductor device also means any device that can function by utilizing semiconductor characteristics. For example, an integrated circuit, and a chip including an integrated circuit are semiconductor devices. Moreover, a storage device, a display device, a light-emitting device, a lighting device, an electronic device, and the like themselves might be semiconductor devices, or might each include a semiconductor device.

Furthermore, in this specification and the like, an explicit description "X and Y are connected" means that X and Y are electrically connected, X and Y are functionally connected, and X and Y are directly connected. Accordingly, without being limited to a predetermined connection relationship, for example, a connection relationship shown in drawings or texts, another connection relationship is included in the drawings or the texts. Here, X and Y each denote an object (e.g., a device, an element, a circuit, a wiring, an electrode, a terminal, a conductive film, and a layer).

Note that a transistor includes three terminals: a gate, a source, and a drain. A gate is a node that controls the conduction state of a transistor. Depending on the channel type of the transistor or levels of potentials applied to the terminals, one of two input/output nodes functions as a source and the other functions as a drain. Therefore, the terms "source" and "drain" can be switched in this specification and the like. In this specification and the like, the two terminals other than the gate may be referred to as a first terminal and a second terminal.

A node can be referred to as a terminal, a wiring, an electrode, a conductive layer, a conductor, an impurity region, or the like depending on the circuit configuration, the device structure, or the like. Furthermore, a terminal, a wiring, or the like can be referred to as a node.

In many cases, a voltage refers to a potential difference between a certain potential and a reference potential (e.g., a ground potential (GND) or a source potential). Thus, a voltage can be referred to as a potential and vice versa. Note that the potential indicates a relative value. Accordingly, "ground potential" does not necessarily mean 0 V.

In this specification and the like, the terms "film" and "layer" can be interchanged depending on the case or circumstances. For example, in some cases, the term "conductive film" can be used instead of the term "conductive layer," and the term "insulating layer" can be used instead of the term "insulating film."

In this specification and the like, ordinal numbers such as first, second, and third are used to avoid confusion among components, and the terms do not limit the components numerically or do not limit the order.

In the drawings, the size, the layer thickness, or the region is exaggerated for clarity in some cases. Therefore, the size, the layer thickness, or the region is not limited to the illustrated scale. Note that the drawings are schematic views showing ideal examples, and embodiments of the present invention are not limited to shapes or values shown in the drawings. For example, the following can be included: variation in signal, voltage, or current due to noise or difference in timing.

In this specification, terms for describing arrangement, such as "over", "above", "under", and "below", are used for convenience in describing a positional relationship between components with reference to drawings in some cases. Furthermore, the positional relationship between components is changed as appropriate in accordance with a direction in which each component is described. Thus, there is no limitation on terms used in this specification, and description can be made appropriately depending on the situation.

The positional relation of circuit blocks illustrated in a block diagram is specified for description. Even when a block diagram shows that different functions are achieved by different circuit blocks, one circuit block may be actually configured to achieve different functions. The functions of circuit blocks are specified for description, and even in the case where one circuit block is illustrated, blocks might be provided in an actual circuit block so that processing performed by one circuit block is performed by a plurality of circuit blocks.

In this specification and the like, a metal oxide means an oxide of metal in a broad sense. Metal oxides are classified into an oxide insulator, an oxide conductor (including a transparent oxide conductor), an oxide semiconductor (also simply referred to as an OS), and the like. For example, a metal oxide used in a semiconductor layer of a transistor is called an oxide semiconductor in some cases. That is to say, a metal oxide that has at least one of an amplifying function, a rectifying function, and a switching function can be called a metal oxide semiconductor, or OS for short. In addition, an OS FET is a transistor including a metal oxide or an oxide semiconductor.

In this specification and the like, a metal oxide including nitrogen is also called a metal oxide in some cases. Moreover, a metal oxide including nitrogen may be called a metal oxynitride.

In this specification and the like, "c-axis aligned crystal (CAAC)" or "cloud-aligned composite (CAC)" may be stated in some cases. CAAC refers to an example of a crystal structure, and CAC refers to an example of a function or a material composition.

In this specification and the like, a CAC-OS or a CAC metal oxide has a conducting function in a part of the material and has an insulating function in another part of the material; as a whole, the CAC-OS or the CAC metal oxide has a function of a semiconductor. In the case where the CAC-OS or the CAC metal oxide is used in a semiconductor layer of a transistor, the conducting function is to allow electrons (or holes) serving as carriers to flow, and the insulating function is to not allow electrons serving as carriers to flow. By the complementary action of the conducting function and the insulating function, the CAC-OS or the CAC metal oxide can have a switching function (on/off function). In the CAC-OS or CAC metal oxide, separation of the functions can maximize each function.

In this specification and the like, the CAC-OS or the CAC metal oxide includes conductive regions and insulating regions. The conductive regions have the above-described conducting function, and the insulating regions have the above-described insulating function. In some cases, the conductive regions and the insulating regions in the material are separated at the nanoparticle level. In some cases, the conductive regions and the insulating regions are unevenly distributed in the material. The conductive regions are observed to be coupled in a cloud-like manner with their boundaries blurred, in some cases.

Furthermore, in the CAC-OS or the CAC metal oxide, the conductive regions and the insulating regions each have a size of more than or equal to 0.5 nm and less than or equal to 10 nm, preferably more than or equal to 0.5 nm and less than or equal to 3 nm and are dispersed in the material, in some cases.

The CAC-OS or the CAC metal oxide includes components having different bandgaps. For example, the CAC-OS or the CAC metal oxide includes a component having a wide gap due to the insulating region and a component having a narrow gap due to the conductive region. In the case of such a composition, carriers mainly flow in the component having a narrow gap. The component having a narrow gap complements the component having a wide gap, and carriers also flow in the component having a wide gap in conjunction with the component having a narrow gap. Therefore, in the case where the above-described CAC-OS or the CAC metal oxide is used in a channel region of a transistor, high current drive capability in the on state of the transistor, that is, high on-state current and high field-effect mobility, can be obtained.

In other words, CAC-OS or CAC metal oxide can be called a matrix composite or a metal matrix composite.

Embodiment 1

In this embodiment, a display device of one embodiment of the present invention will be described.

<Display Device 200>

FIG. 1A illustrates a display device of one embodiment of the present invention. The display device 200 shown in FIG. 1A includes an input portion 151, a control portion 152, a display portion 102, a gate driver 112, a source driver 113, and a touch sensor 114.

The display device 200 preferably includes a display portion 104. The display portion 102, the display portion 104, and the touch sensor 114 are preferably placed so as to overlap with each other.

The display portion 102 includes a plurality of pixels 61. The display portion 104 includes a plurality of pixels 62.

Figure 1B:
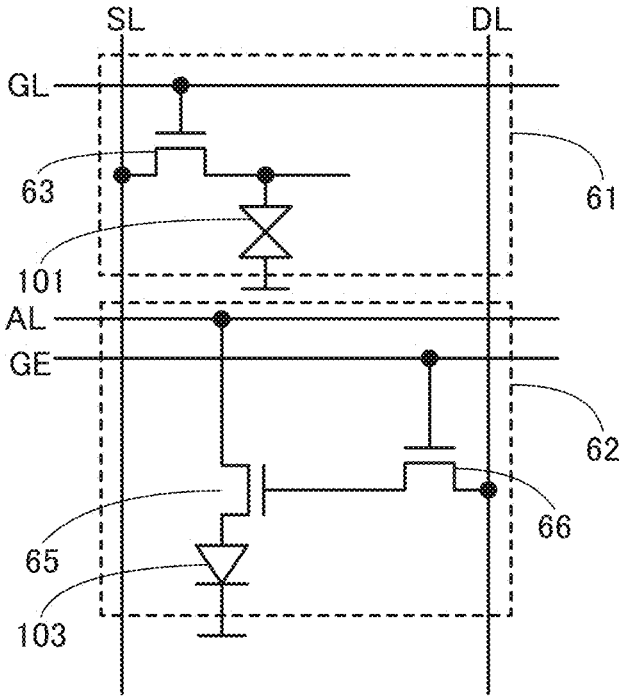

The display portion 102 includes a display element 101 (the display element 101 is illustrated in FIG. 1B which is described later). The display element 101 preferably includes a liquid crystal element. The display element 101 preferably has a function of expressing a grayscale level by utilizing light reflection. For example, a reflective liquid crystal element can be used as the display element 101. The liquid crystal element has a capacitor structure in which electric charge is accumulated. The liquid crystal element includes two electrodes (a pixel electrode and a common electrode) and a liquid crystal interposed therebetween.

The reflective liquid crystal element uses external light as a light source. A display device using the reflective liquid crystal element provides a clear and beautiful image. In addition, no backlight is necessary; thus, power consumption can be reduced. The response speed of the reflective liquid crystal element is higher than that of electronic paper or the like. The power consumption of the display device using the reflective liquid crystal element can be significantly reduced by using IDS driving (which is described later) in the display device. The display device with the combination of the reflective liquid crystal element and IDS driving has low power consumption and excellent display image quality and is therefore suitable as a portable terminal to display a book, especially a book including drawings or images (such as a textbook or a reference book).

The display portion 104 includes a display element 103 (the display element 103 is illustrated in FIG. 1B which is described later). The display element 103 is preferably a light-emitting display element. For example, an organic EL element can be used as the display element 103. The display device 200 including the display element 103 can display a high-quality image even in the case where external light is weak. In other words, the display device 200 can be used in a wide range of situations and environments. The display element 101 and the display element 103 are preferably combined to display an image because they can provide an improved image representation.

The display portion 102 and the display portion 104 each include a plurality of pixels. The pixels include switching elements (e.g., a transistor 63 and a transistor 66 in FIG. 1B) for controlling connection to gate lines (e.g., a wiring GL and a wiring GE in FIG. 1B) with gate signals. When the switching elements are turned on, data signals are written to the pixels through source lines (e.g., a wiring SL and a wiring DL in FIG. 1B). When the switching elements are turned off, data in the pixels are held.

As an example of the pixel included in the display portion 102, the pixel 61 is illustrated in FIG. 1B. The pixel 61 includes the display element 101 and the transistor 63. A gate of the transistor 63 is electrically connected to the wiring GL to which a gate signal is supplied. One of a source and a drain of the transistor 63 is electrically connected to the wiring SL to which a data signal is supplied, and the other of the source and the drain of the transistor 63 is electrically connected to one electrode of the display element 101. As the transistor 63, an FET in which an oxide semiconductor is included in a channel formation region (hereinafter, such an FET is also referred to as an OS-FET) is preferably used. For the transistor 63, a transistor 303 in another embodiment to be described later may be referred to.

As an example of the pixel included in the display portion 104, the pixel 62 is illustrated in FIG. 1B. The pixel 62 includes the display element 103. The pixel 62 preferably includes a transistor 65, the transistor 66, and the like. For the transistor 65 and the transistor 66, a transistor 305 and a transistor 306 in another embodiment to be described later may be referred to.

The pixel 61 and the pixel 62 are preferably adjacent to each other. The pixel 61 and the pixel 62 may partly overlap with each other.

In the case where the display portion 102 and the display portion 104 display the same image, the same image signal is written to the pixel 61 and the pixel 62, for example. When the display portion 102 and the display portion 104 display the same image, an image with a unique texture, for example, can be obtained. In some cases, an eye-friendly image can be obtained.

The control portion 152 includes a comparison circuit 121, a storage circuit 122, a measurement circuit 123, and a write circuit 124.

The measurement circuit 123 controls the hold time of an image that is displayed on the display portion 102 and the display portion 104.

The storage circuit 122 has a function of storing an Nth video signal and an (N+1)th video signal.

The comparison circuit 121 compares the (N+1)th video signal supplied to the comparison circuit 121 and the Nth video signal stored in the storage circuit 122 and outputs a comparison result. The write circuit 124 writes the (N+1)th video signal predetermined times depending on the comparison result of the comparison circuit 121 and the interval between writing of the Nth video signal and writing of the (N+1)th video signal. The number of times of writing to the display portion 102 is determined to be one or an odd number of three or more.

Data from the write circuit 124 is supplied to the gate driver 112 and the source driver 113. An image is displayed on the display portion 102 and the display portion 104 depending on the data supplied to the gate driver 112 and the source driver 113.

Data from the touch sensor 114 is supplied to the input portion 151 and the measurement circuit 123. When data is supplied to the touch sensor 114 by a user, a display switch signal or the like is supplied to the input portion 151, for example.

In the control portion 152, for example, a start pulse (GSP), a clock signal (GCLK), and the like are generated as signals for controlling the gate driver 112, and a start pulse (SSP), a clock signal (SCLK), and the like are generated as signals for controlling the source driver 113. Note that such signals may each be a group of signals instead of a single signal.

The control portion 152 also includes a power control unit and controls the supply of a power source voltage to the drivers (112, 113) and the suspension thereof.

When GSP is input to the gate driver 112, a gate signal is generated in accordance with GCLK and output to each gate line sequentially. The gate signal selects a pixel to which a data signal is to be written.

The source driver 113 processes an image signal (Video) to generate a data signal and outputs the data signal to the source line. When SSP is input to the source driver 113, a data signal is generated in accordance with SCLK and output to source lines sequentially.

<Operation Method of Display Portion 102>

A case where the display portion 102 displays an image which does not change over time (such as a still image) or an image which changes with low frequency is considered here. The off-state leakage of an OS-FET is extremely low. When an OS-FET is used as the transistor 63 that is a switching transistor in a pixel with a liquid crystal element, leakage can be minimized. Thus, data degradation can be suppressed, and data can be held for an extremely long time. For example, the frequency of refresh can be lowered when a still image with no change in image data or an image with a low frequency of change in image data is displayed for a long time. Thus, display can be performed with low frequency. A decrease in display frequency enables a reduction in power consumption of the display device.

For example, in the case of displaying a still image or the like, the display frequency can be lower than or equal to 1 Hz, preferably lower than or equal to 0.3 Hz, further preferably less than or equal to 0.1 Hz. In some cases, driving of the display device with such a low display frequency of less than or equal to 1 Hz is referred to as "IDS driving." The details of "IDS driving" will be described later.

With the use of such excellent characteristics of an OS-FET, excellent display with little degradation of image quality can be achieved even at a low frequency of rewriting.

On the other hand, "burn-in" occurs in a liquid crystal element in some cases. The term "burn-in" here refers to a state in which, when ionic impurities and the like are included in a liquid crystal element in addition to liquid crystal molecules, which are a major component, a grayscale level is gradually changed because the liquid crystal molecules are affected by the impurities in a long hold period, for example.

For example, in the case of switching from display with high transmissivity (high grayscale level display) to halftone display, the transmissivity is increased gradually after the switching, in some cases. In the case of switching from display with low transmissivity (low grayscale level display) to halftone display, the transmissivity is decreased gradually after the switching, in some cases. In the case where the refresh rate is extremely low as in IDS driving, such a small change over time may lead to a reduction in display quality.

Thus, the influence of the burn-in of a liquid crystal element is preferably reduced in terms of displaying a better image using IDS driving.

By performing high grayscale level display or low grayscale level display (high-contrast grayscale level display), the influence of the burn-in in a liquid crystal element can be reduced. In contrast, when halftone display is performed, the burn-in in a liquid crystal element causes a reduction in display quality in some cases. By successively writing the same data twice or more for example, the influence of the burn-in in the liquid crystal element can be reduced.

[The Number of Writing Times]

Figure 8A:
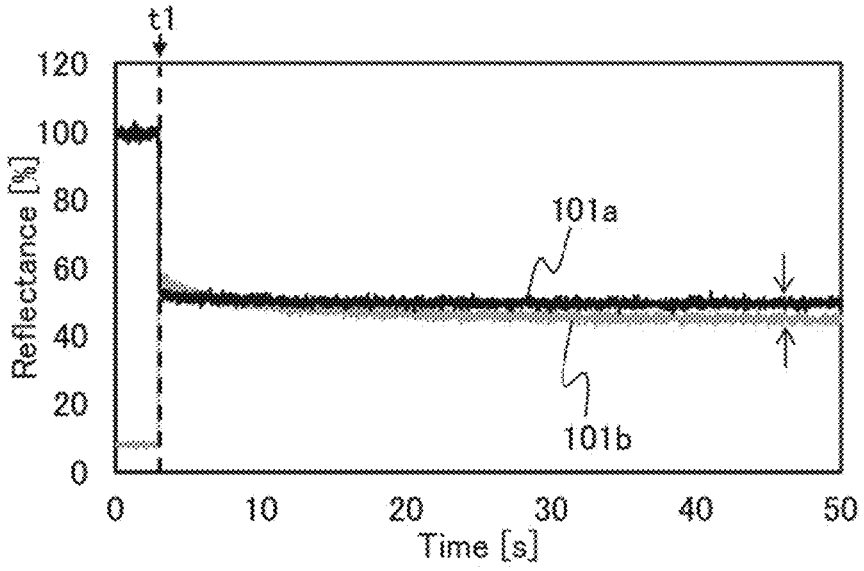
FIGS. 8A and 8B show reflectances of liquid crystal elements.
Figure 8B:
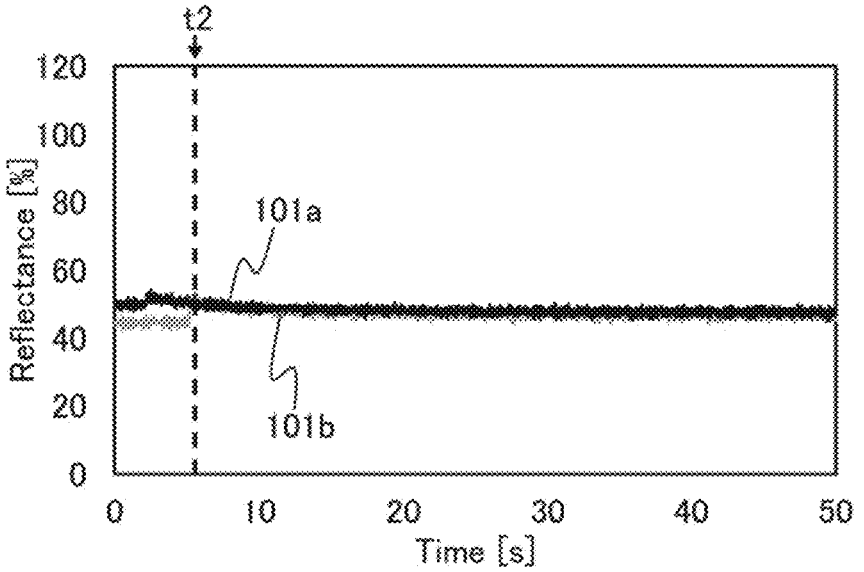

FIGS. 8A and 8B show changes in the reflectances of reflective liquid crystal elements over time. The hold characteristics of a liquid crystal element 101*a* and a liquid crystal element 101*b* are shown in FIG. 8A. To the liquid crystal element 101*a* to which white had been written in advance, gray was written at Time t1, and the gray was held. To the liquid crystal element 101*b* to which black had been written in advance, gray was written at Time t1, and the gray was held. The number of grayscale levels of the display device is 256, and the gray is at a 128th grayscale level. The reflectance of the liquid crystal element 101*a* is gradually increased and the reflectance of the liquid crystal element 101*b* is gradually decreased over time, and the difference is visually recognized as image burn-in.

Then, gray was written again at Time t2 to the liquid crystal elements 101*a* and 101*b* having different reflectances due to the burn-in, and the gray was held. The results are shown in FIG. 8B. It is shown that, by performing the second writing, a change in the reflectance with the hold time can be suppressed and the influence of the burn-in can be suppressed.

The dipole moment of each of the liquid crystal elements used in the evaluation shown in FIGS. 8A and 8B was 2.3, and the resistivity thereof was greater than or equal to $1.0\times10^{14}$ [Ω·cm].

Figure 9:
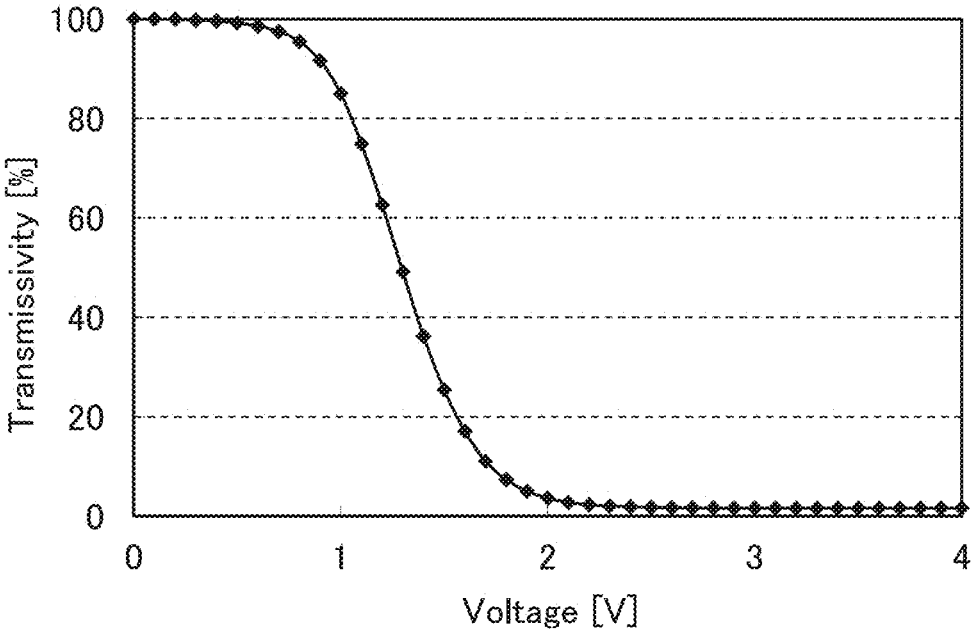
FIG. 9 shows the relation between the transmissivity and the driving voltage of a liquid crystal element.

FIG. 9 shows the relation between the driving voltage of the liquid crystal element and the transmissivity of the liquid crystal element. The horizontal axis represents the driving voltage of the liquid crystal element, and the vertical axis represents the transmissivity of the liquid crystal element. A twisted nematic (TN) mode was used as the operation mode of the liquid crystal layer. In a region where the transmissivity is higher than 20% and lower than 80%, a change in the transmissivity with respect to the driving voltage is rapid and the influence of the burn-in is larger. Thus, it can be said that the region where the transmissivity is higher than 20% and lower than 80% is affected more easily by a change in the voltage applied to the liquid crystal element.

In contrast, a region where the transmissivity is lower than or equal to 20% and a region where the transmissivity is higher than or equal to 80% are affected less easily by a change in the voltage applied to the liquid crystal element than the region where the transmissivity is higher than 20% and lower than 80%.

The grayscale levels of an image that is displayed on the display portion 102 are $C_X$ at maximum, where $C_X$ is a positive integer, e.g., 16 or 256.

The high-contrast grayscale level refers to a grayscale level of $0.7C_X$ or higher, or $0.3C_X$ or lower, preferably, a grayscale level of $0.8C_X$ or higher, or $0.2C_X$ or lower, for example. In this specification and the like, a grayscale level that is $0.7C_X$ or higher, preferably $0.8C_X$ or higher is referred to as near white, and a grayscale level that is $0.3C_X$ or lower, preferably $0.2C_X$ or lower is referred to as near black. Furthermore, a grayscale level that is higher than $0.3C_X$ and lower than $0.7C_X$, preferably higher than $0.2C_X$ and lower than $0.8C_X$, e.g., a grayscale level that is higher than or equal to the 52nd grayscale level and lower than or equal to the 204th grayscale level (higher than or equal to 51 and lower than or equal to 203) in the case of 256 grayscale levels (from 0 to 255), is referred to as halftone in some cases.

[Process Flowchart]

Figure 2:
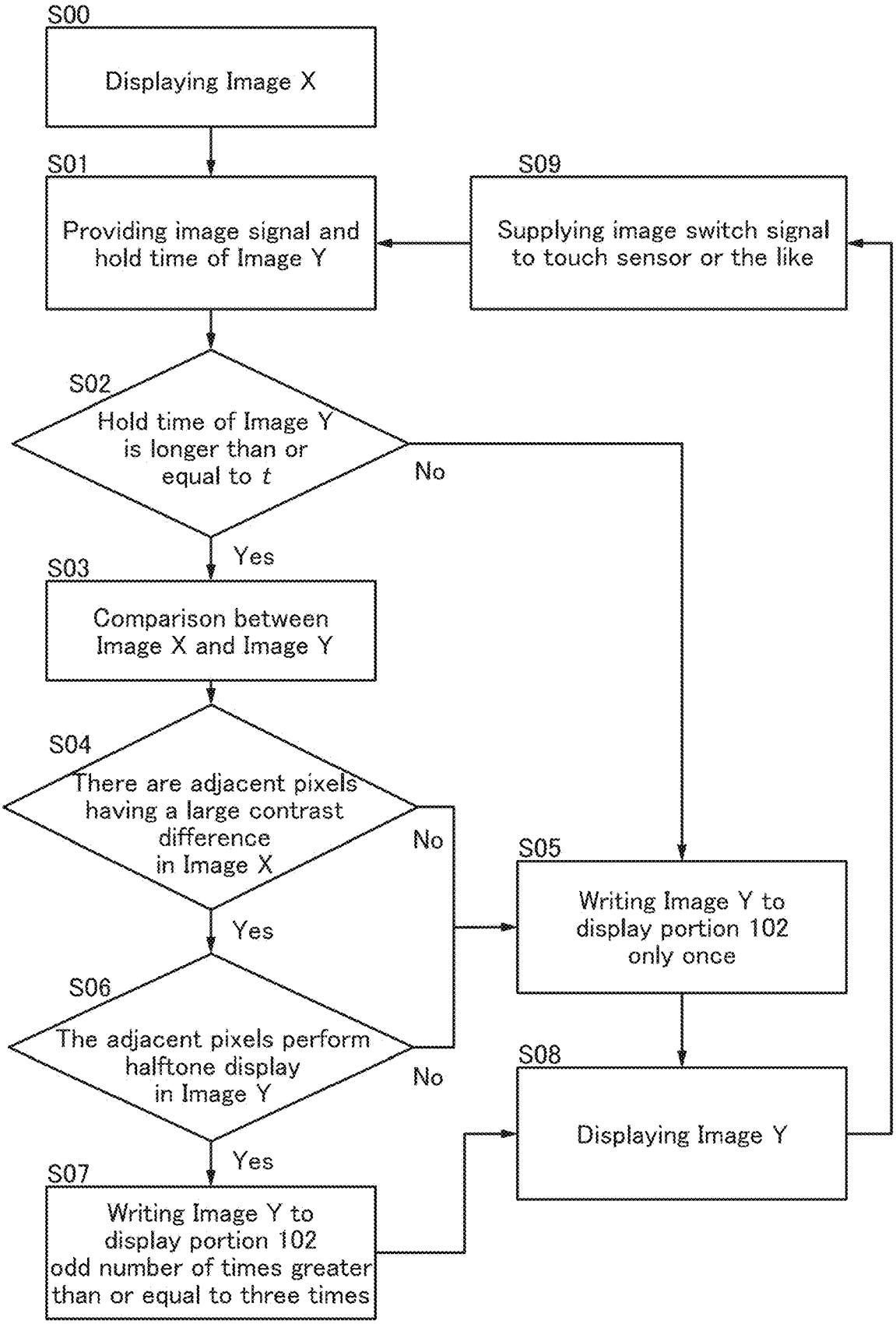
FIG. 2 is a flowchart illustrating an example of an operation method of a display device.

An operation method of the display device of one embodiment of the present invention will be described with reference to a flowchart in FIG. 2.

In the display device 200, Image X is displayed (Step S00).

First, in Step S01, an image signal and a hold time of an image that is displayed after Image X (an image that is displayed at present) is displayed are provided. The image that is displayed after Image X is displayed is hereinafter referred to as Image Y. Image X here is an Nth image signal, for example. Image Y here is an (N+1)th image signal, for example.

When the hold time of Image Y is longer than or equal to t in Step S02, the process proceeds to Step S03. When the hold time of Image Y is shorter than t, the process proceeds to Step S05. Here, t is preferably 1 second, further preferably 3 seconds, still further preferably 10 seconds.

The hold time of Image Y is preferably longer than or equal to 1 second and shorter than or equal to 10,000 hours, further preferably longer than or equal to 3 seconds and shorter than or equal to 1,000 hours, still further preferably longer than or equal to 10 seconds and shorter than or equal to 200 hours.

In the case where the process proceeds to Step S03, Image X and Image Y are compared with each other using the comparison circuit 121. Then, it is determined from the comparison result in Step S04 whether there are adjacent pixels having a large contrast difference in Image X. When adjacent pixels having a large contrast difference exist, the process proceeds to Step S06. When adjacent pixels having a large contrast difference do not exist, the process proceeds to Step S05. In the flowchart shown in FIG. 2, the comparison of Image X with Image Y is performed in a period between the end of display of Image X and the start of display of Image Y. The comparison of Image X with Image Y may be performed before Image X is displayed, for example; in that case, the comparison result is stored in the storage circuit 122, for example.

In the case where the process proceeds to Step S06, Image Y is analyzed in Step S06. When the pixels that are determined to have a large contrast difference in Step S04 perform halftone display in Image Y, the process proceeds to Step S07. When the pixels do not perform halftone display in Image Y, the process proceeds to Step S05.

In the case where the process proceeds to Step S05, Image Y is written to the display portion only once in Step S05. After that, Image Y is held in Step S08.

In the case where the process proceeds to Step S07, Image Y is written an odd number of times greater than or equal to three times in Step S08. Then, Image Y is held in Step S08.

After Step S08, an image switch signal, e.g., an (N+2)th image signal here, is supplied from an external portion or an internal portion to a touch sensor or the like in Step S09. After that, Steps S01 to S09 are performed while the (N+1)th image signal and the (N+2)th image signal are used as Image X and Image Y, respectively.

Steps S01 to S09 are repeatedly performed every time an image is switched.

The comparison between Image X and Image Y in Steps S04 to S07 is described with reference to FIGS. 3A and 3B and FIGS. 4A to 4C.

Figure 3A:
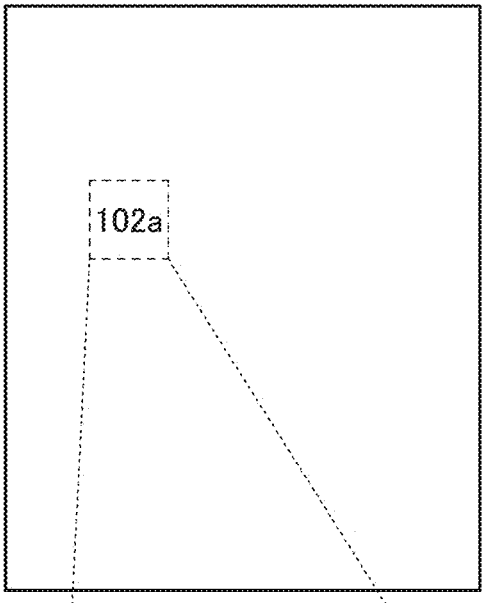
FIGS. 3A and 3B show an example of display of pixels included in a display device.
Figure 3B:
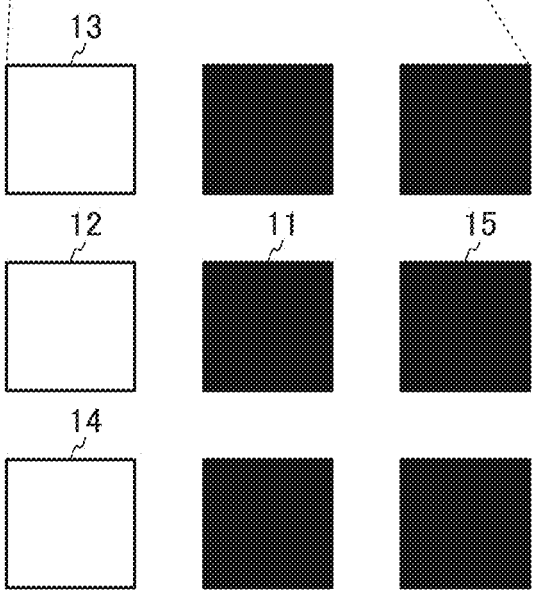
Figure 4A:
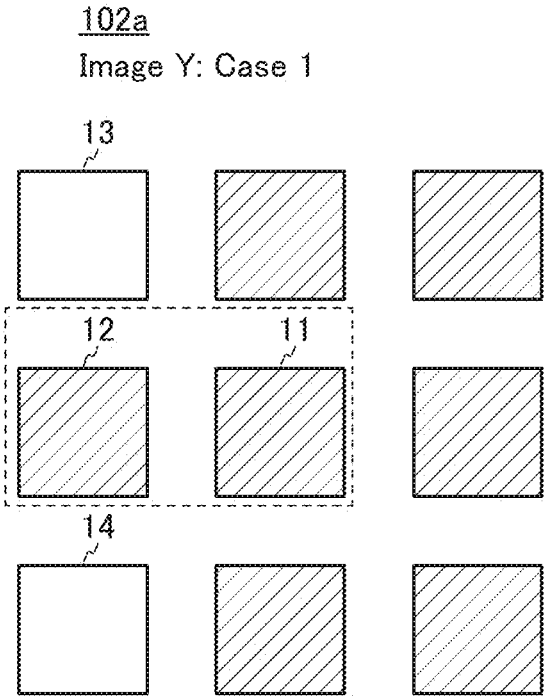
FIGS. 4A to 4C show examples of display of pixels included in a display device.
Figure 4B:
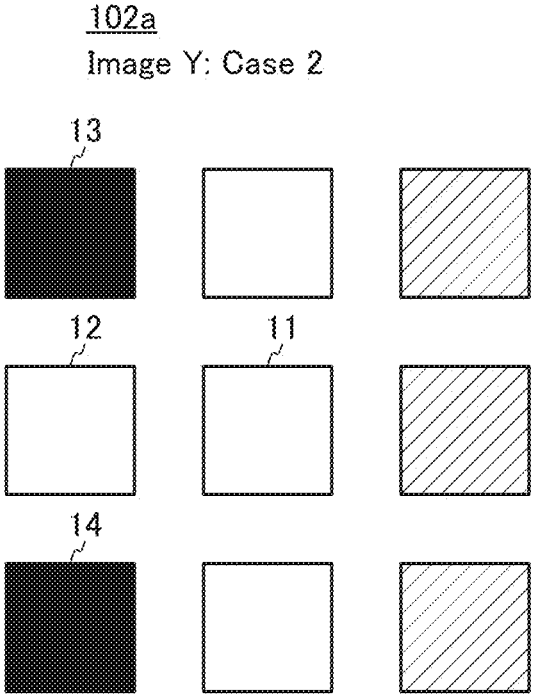
Figure 4C:
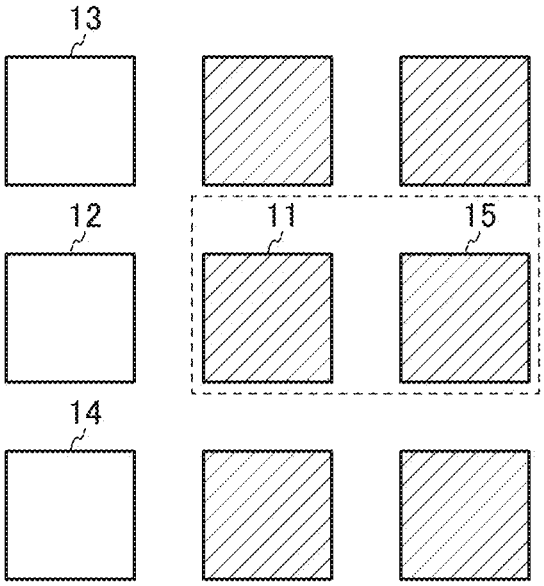

As shown in FIG. 3A, a region in pixels included in the display portion 102 is denoted by a region 102*a*. FIG. 3B shows pixels included in the region 102*a*. The region 102*a* includes the pixel 11 and pixels adjacent to the pixel 11. An example of the region 102*a* in the case of displaying Image X (e.g., the Nth image signal here) is shown in FIG. 3B. Three examples (Case 1, Case 2, and Case 3) of the region 102*a* in the case of displaying Image Y (e.g., the (N+1)th image signal here) are shown in FIGS. 4A to 4C.

The case is considered where one of an image signal for Image X that is written to the pixel 11 and an image signal for Image X that is written to a pixel adjacent to the pixel 11 has a grayscale level of near black, e.g., $0.2C_X$ or lower, and the other image signal has a grayscale level of near white, e.g., $0.8C_X$ or higher. In the example shown in FIG. 3B, the pixel 11 has a grayscale level of $0.2C_X$ or lower and pixels 12, 13, and 14 that are adjacent to the pixel 11 each have a grayscale level of near white, i.e., $0.8C_X$ or higher here. There is a large contrast different between the pixel 11 and the pixels 12 to 14 adjacent to the pixel 11. In FIG. 3B, the pixel 11 expresses a first grayscale level (0), i.e., black, whereas the pixels 12 to 14 express the 256th grayscale level (255), i.e., white.

In the case where data of an image signal for Image Y that is written to the pixel 11 and at least one of the pixels 12 to 14 is halftone, e.g., data of higher than $0.2C_X$ and lower than $0.8C_X$, the influence of the burn-in of liquid crystals is large in some cases. In the example shown in FIG. 4A (Case 1), halftone of a 128th grayscale level (127) is displayed in the pixels 11 and 12, and white is displayed in the pixels 13 and 14. The (N+1)th image signal is preferably written a plurality of times, further preferably an odd number of times greater than or equal to three times, since halftone is displayed in the pixels 11 and 12. The reason for setting the number of writing times to an odd number is described later.

In the case where image signals for Image Y that are written to the pixels 11 to 14 each have a grayscale level of near black or near white ($0.2C_X$ or lower, or $0.8C_X$ or higher, in this example), i.e., the image signals each have a high-contrast grayscale level, the influence of the burn-in of liquid crystals is small. FIG. 4B shows the example (Case 2) where the (N+1)th image signal is different from that in FIG. 4A. In FIG. 4B, white is expressed by the pixels 11 and 12, whereas black is expressed by the pixels 13 and 14. In that case, the image signals for Image Y are written only once. Writing the image signals only once leads to an extreme reduction in the power consumption of the display device.

FIG. 4C shows an example (Case 3) where image signals for Image Y are different from those shown in FIG. 4A and FIG. 4B. First, the pixel 11 and a pixel 15 are considered. In FIG. 3B, the grayscale levels of the pixels 11 and 15 are each near black, i.e., $0.2C_X$ or lower here. The grayscale levels of the pixels 11 and 15 are not halftone and the contrast difference between the pixels 11 and 15 is small. In FIG. 4C, the pixels 11 and 15 perform halftone display (a 128th grayscale level (127) here). In this case, the influence of the burn-in is small. This is because the pixels 11 and 15 have a small contrast difference in the image signals for Image X. Next, the pixels 12, 13, and 14 are considered. In FIG. 3B, there is a large contrast difference between the pixel 11 and the pixels 12, 13, and 14. In FIG. 4C, the pixels 12, 13, and 14 display an image of near white, e.g., an image of $0.8C_X$ or higher (white here). Since the image is not a halftone image, the influence of the burn-in is small. Thus, in the case where the image signals for Image Y are as shown in FIG. 4C, writing the image signals for Image Y only once is enough.

The pixel 61 shown in FIG. 1B can be used as each of the pixels 11 to 15 shown in FIG. 3B and FIGS. 4A to 4C.

Comparing the pixel 11 with the pixels adjacent thereto has been described using FIGS. 3A and 3B and FIGS. 4A to 4C. All of pixels are preferably compared with the pixels adjacent thereto in the display device of one embodiment of the present invention. Alternatively, a pixel in a display region in the display portion 102 may be compared with a pixel adjacent thereto.

[Timing Chart]

Figure 5A:
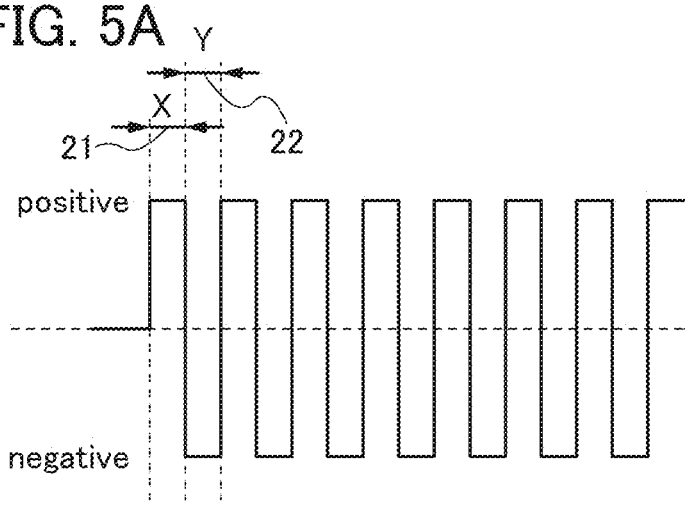
FIGS. 5A to 5C are timing charts illustrating examples of an operation method of a display device.
Figure 5B:
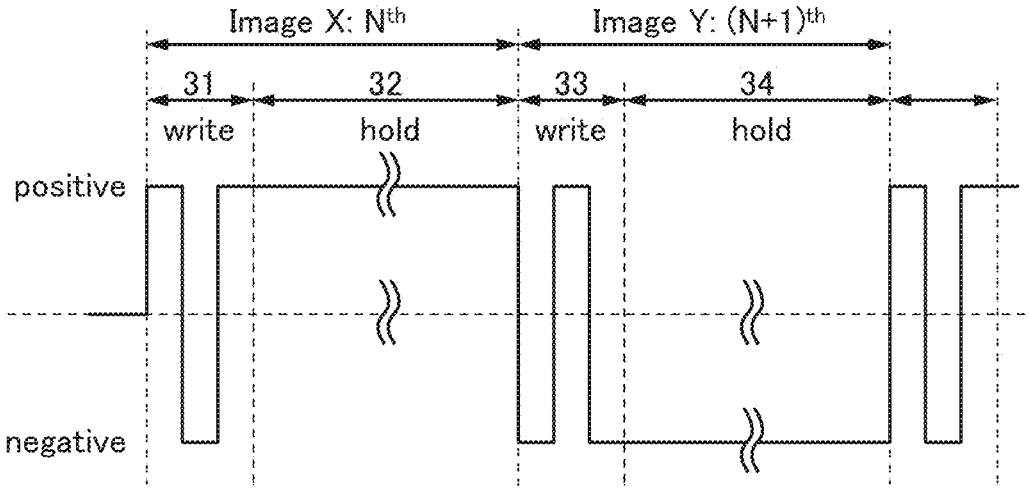
Figure 5C:
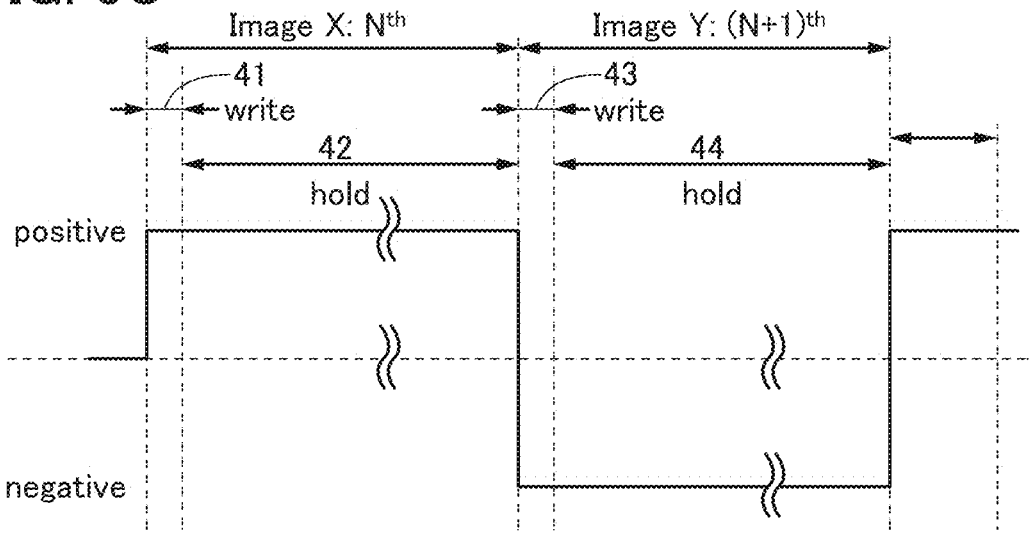

Writing to the display portion 102 is described using timing charts shown in FIGS. 5A to 5C. FIGS. 5A to 5C show the polarity of a data signal (hereinafter Vdata) output from the source driver 113 to the source line (the wiring SL) in different driving modes of the display portion 102.

FIG. 5A shows a driving method in which data is sequentially rewritten every frame. In an example shown in FIG. 5A, an image is rewritten at a comparatively high frequency, e.g., 30 Hz or higher, preferably 60 Hz or higher. An image signal for Image X is written in a period 21 corresponding to one frame, and an image signal for Image Y is written in a period 22 corresponding to a subsequent frame. It is preferable that opposite polarities of Vdata be applied alternately. The polarity of Vdata is determined on the basis of Vcom. Note that Vcom is a reference potential. When Vdata is higher than Vcom, the polarity of Vdata is referred to as a positive polarity, and when Vdata is lower than Vcom, the polarity of Vdata is referred to as a negative polarity. A signal with a positive polarity and a signal with a negative polarity are alternately written. When the polarity of a signal applied to a liquid crystal element is biased, the liquid crystal element deteriorates significantly in some cases.

FIG. 5B shows a driving method in which data rewriting is stopped after data write processing is executed. This method is called "idling stop (IDS) driving". For example, in the case of displaying a still image, it is not necessary to rewrite data every frame. When the display portion 102 is operated by IDS driving in the case of displaying a still image, power consumption can be reduced, and screen flicker can be suppressed. FIG. 5B shows an example in which, after an image signal is written three times at a comparatively high frequency, e.g., a frequency higher than or equal to 30 Hz and lower than or equal to 240 Hz, preferably higher than or equal to 50 Hz and lower than or equal to 130 Hz, the image signal is held. First, in a period 31 corresponding to three frames, the Nth image signal is written three times at a comparatively high frequency, i.e., 60 Hz here. In the period 31, a positive voltage is applied in the first writing and the third writing, and a negative voltage is applied in the second writing. After the third writing, the image data is held in a period 32. The hold time t is set to one second here. In the hold period, the data can be held by turning off a pixel transistor and setting an input signal in an off state. "Setting an input signal in an off state" refers to stopping the supply of a control signal to the gate driver 112 or the source driver 113, for example. By stopping the supply of a control signal, signals such as GSP, GCLK, SSP, and SCLK can be stopped.

Then, in a period 33, an image signal for Image Y is written three times at a frequency of 60 Hz. In the period 33, a negative voltage is applied in the first writing and the third writing, and a positive voltage is applied in the second writing. After the third writing, image data is held in a period 34. In the hold period, the data can be held by turning off the pixel transistor and setting the input signal in an off state.

In the period 32, data is held at the positive voltage. In the period 34, data is held at the negative voltage. By setting the number of writing to an odd number as described above, the polarity of the hold period can be changed alternately, so that the degradation of the liquid crystal element is suppressed.

The number of writing is three in FIG. 5B but may be an odd number of three or more. For example, the number of writing is an odd number greater than or equal to 3 and less than or equal to 9.

In the example shown in FIG. 5B, Vdata written three times is produced on the basis of the same image signal and has the polarities of positive, negative, and positive in this order in the period 31. However, the same image signal need not be necessarily used. For example, after near white or near black is displayed on the entire screen of the display portion 102 in at least one of the first writing and the second writing, a desired image signal is written in or after the third writing. Implementing such a display method can suppress display unevenness.

FIG. 5C shows a timing chart of the case where data is written once. To display an Nth image, writing is performed once in a period 41 and held in a period 42. Then, to display an (N+1)th image, writing is performed once in a period 43 and held in a period 44. In the hold period, the signal can be held by turning off a pixel transistor and setting an input signal in an off state. The writing time is set to 1/20 seconds and the hold time t is set to one second here.

Figure 6:
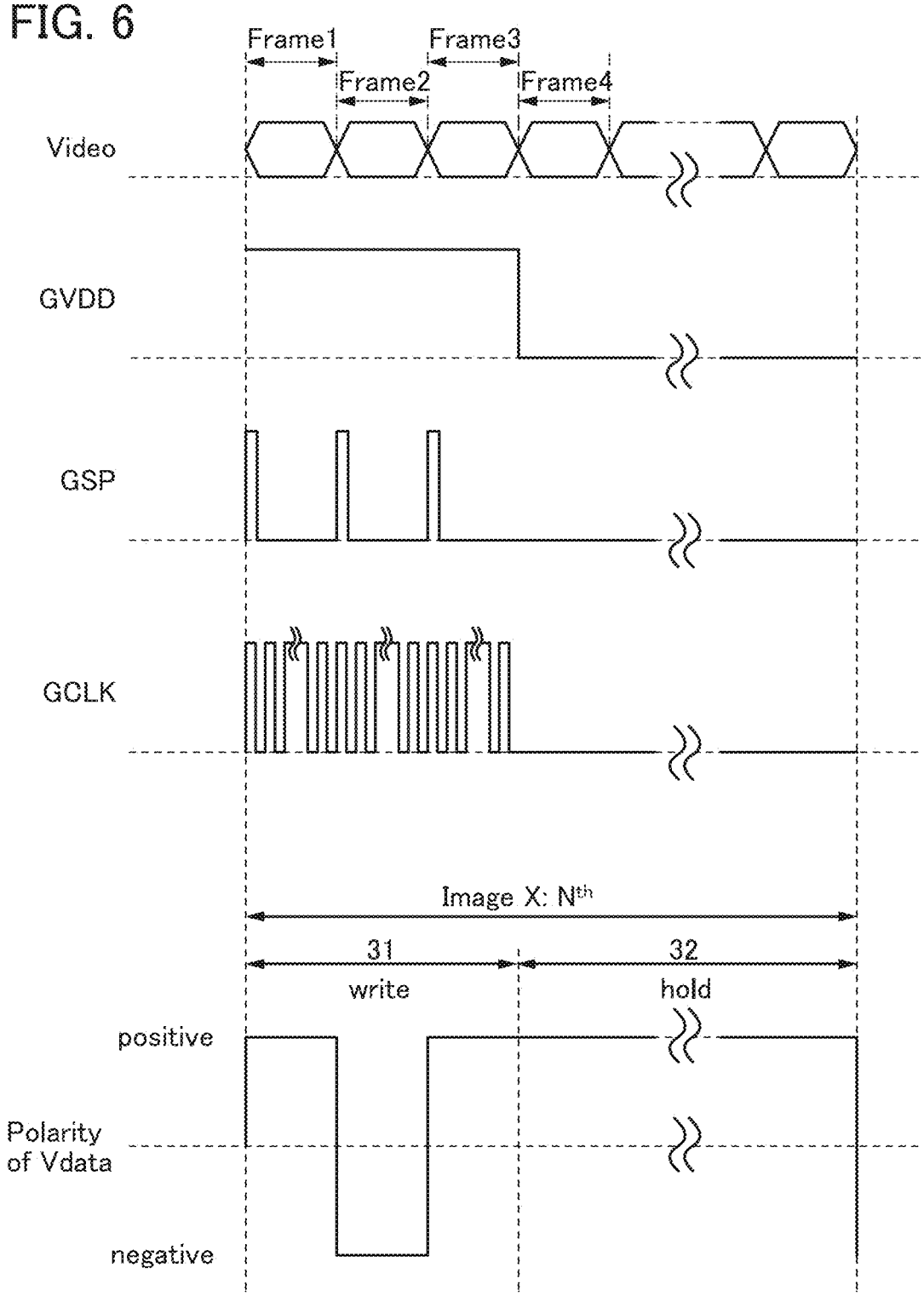
FIG. 6 is a timing chart showing an example of an operation method of a display device.

FIG. 6 shows examples of GVDD, GSP, and GCLK in the driving method shown in FIG. 5B. Here, GVDD is a high power supply voltage of the gate driver 112.

First, in a first frame (Frame 1), in response to an input of GSP, the gate driver 112 generates a gate signal in accordance with GCLK and outputs the gate signal to gate lines. The source driver 113 (not illustrated), when supplied with SSP (not illustrated), processes an image signal in accordance with SCLK (not illustrated) to generate Vdata and outputs Vdata sequentially to source lines. At that time, Vdata with a positive polarity is generated.

Next, in a second frame (Frame 2), a gate signal and Vdata are generated in a similar procedure. In the second frame, Vdata with a negative polarity is generated.

Next, in a third frame (Frame 3), a gate signal and Vdata are generated in a similar procedure. In the third frame, Vdata with a positive polarity is generated.

In the case where a still image is displayed, the same signal is used in Frame 1, Frame 2, and Frame 3. Note that in Frame 2, the polarity of the signal is opposite to the polarity of the signal in Frame 1 and Frame 3.

Next, from a fourth frame (Frame 4), the transistor 63 that is a switching transistor in a pixel is turned off, and the written image is held. Since data rewriting is suspended from Frame 4, the supply of GSP and GCLK can be suspended. The supply of GVDD may also be suspended.

[Image Information]

As described above using FIGS. 5A to 5C, the number of writing to the display portion 102 is preferably one or an odd number of three or more. In the case where an image that is displayed on the display device 200 has a high contrast, e.g., in the case where text information or the like is displayed, the number of writing to the display portion 102 can be only one, whereby the power consumption of the display device 200 is extremely reduced.

The display device of one embodiment of the present invention can display letters, drawings, and pictures, for example. Letters are formed by data with a high contrast, for example. Data for displaying drawings and pictures has halftone in many cases, for example.

The display device of one embodiment of the present invention is capable of displaying information of a book, for example. Examples of the book include a textbook.

The information of a book contains many letters. The switching speed of data containing letters is low, for example; therefore, the data is preferably displayed in a still image or at a low frequency in some cases. In these cases, display is preferably performed using the display portion 102. Displaying the data as a still image or at a low frequency on the display portion 102 can reduce the power consumption of the display device 200.

Letters are formed by data with a high contrast, for example. Thus, in the case where image signals for Image X and Image Y are text information, writing an image signal for Image Y to the display portion 102 only once is enough. That is, the power consumption of the display device of one embodiment of the present invention can be extremely reduced in a period in which letters are repeatedly displayed on the display device. Accordingly, in the case where the display device of one embodiment of the present invention is driven with a storage battery for example, the display device can be driven with the storage battery for a long time. Moreover, the number of times of charging the storage battery can be reduced.

<Operation Method of Display Device 200>

The display mode can be switched in the display device 200. Switching the display mode refers to selecting displaying an image on the display portion 102 or the display portion 104 or displaying an image on both of the display portion 102 and the display portion 104. The display mode can be switched depending on the intensity of external light, user's preference, the kind of image, or the like.

For example, an image is displayed on only the display portion 102 in intense external light conditions, and an image is displayed on the display portion 104 in weak external light conditions in the display device 200.

For example, an image is displayed on the display portion 102 and the display portion 104 at the same time in the display device 200. When an image is displayed on the display portion 102 and the display portion 104 at the same time, an image with a unique texture can be obtained. In some cases, an eye-friendly image can be obtained.

When the display portion 104 displays an image, wide viewing angle display may be achieved, for example. By achievement of wide viewing angle display, the display device 200 can be used regardless of the viewing angle. In some cases, the same display screen may be easily viewed by a plurality of people.

The display portion 102 may display a color image or a grayscale image, for example. The display portion 104 preferably displays a color image.

The case where the display portion 102 and the display portion 104 of the display device 200 display a grayscale image and a color image, respectively, will be considered here. In that case, for example, the display portion 102 displays an image in the case where a grayscale image is to be displayed by the display device 200, and the display portion 104 displays an image in the case where a color image is to be displayed. For example, the display portion 102 may display text information constituted by a grayscale image or a black-and-white image, and the display portion 104 may display a color image including a drawing, a picture, or the like.

Figure 7:
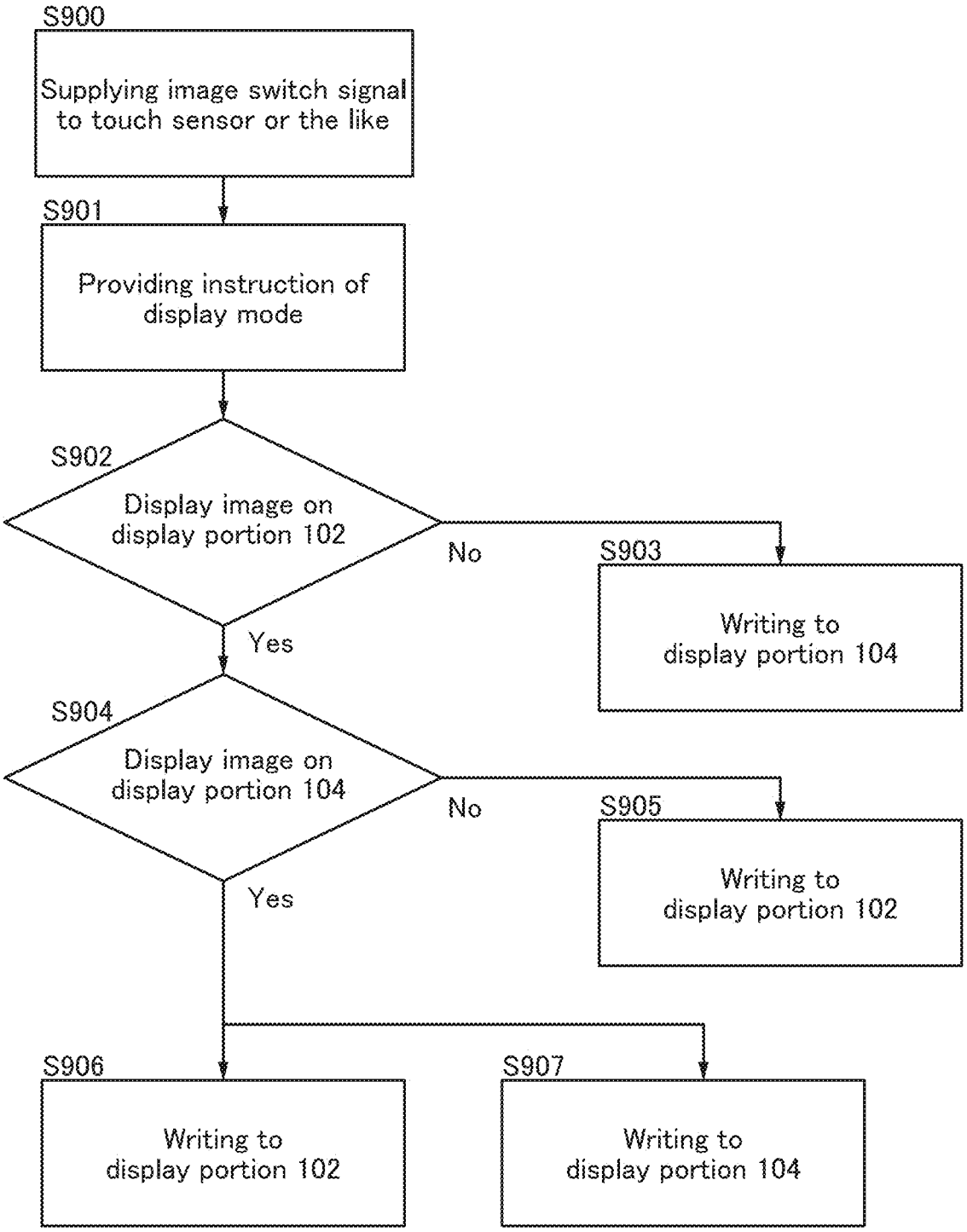
FIG. 7 is a flowchart illustrating an example of an operation method of a display device.

Switching of the display mode of the display device 200 is described using a flowchart in FIG. 7. In Step S900, an image switch signal is supplied from an external portion or an internal portion to a touch sensor or the like.

In Step S901, an instruction is given to specify a display mode. In Step S902, whether to display an image on the display portion 102 is determined depending on the display mode. In the case where an image is not displayed on the display portion 102, writing to the display portion 104 is performed in Step S903. In the case where an image is displayed on the display portion 102, the process proceeds to Step S904. In Step S904, whether to display an image on the display portion 104 is determined. In the case where an image is not displayed on the display portion 104, writing to the display portion 102 is performed in Step S905. In the case where an image is displayed on the display portion 102, writing to the display portion 102 is performed in Step S906, and writing to the display portion 104 is performed in Step S907. Steps S01 to S08 shown in FIG. 2 can be used for writing to the display portion 102 in Steps S905 and S906. In the case where writing to the display portion 102 is performed an odd number of times greater than or equal to three times in Step S07, the timing chart shown in FIG. 6 can be used. In the case where writing to the display portion 102 is performed an odd number of times greater than or equal to three times in Step S906, the writing to the display portion 104 is performed concurrently with the writing to the display portion 102 in any one of Frames 1 to 3 in FIG. 6, or the writing to the display portion 104 is performed at the start of Frame 4.

This embodiment can be combined with any of the other embodiments as appropriate.

Embodiment 2

Described in this embodiment is a liquid crystal material that is preferably used in a liquid crystal element included in the display device of one embodiment of the present invention when the liquid crystal element is operated using IDS driving.

<Dipole Moment>

First described is the influence of a molecule whose dipole moment is greater than or equal to 0 debye and less than or equal to 3 debye, which is included in the liquid crystal layer. Table 1 shows the relation between the dipole moment of the molecule and the resistivity as an example of the liquid crystal layer including the molecule whose dipole moment is greater than or equal to 0 debye and less than or equal to 3 debye.

TABLE 1

| μ [debye] | ρ [Ω · cm] |
|---|---|
| 0.047 | 2.43E+14 |
| 0.114 | 6.71E+14 |
| 0.124 | 3.71E+14 |
| 0.152 | 1.66E+14 |
| 0.275 | 2.06E+12 |
| 0.430 | 3.01E+12 |
| 0.439 | 1.85E+12 |
| 0.523 | 1.29E+14 |
| 0.702 | 5.82E+12 |
| 0.974 | 7.94E+12 |
| 1.00 | 1.71E+14 |
| 1.01 | 2.82E+12 |
| 1.17 | 1.31E+14 |
| 1.29 | 3.48E+14 |
| 1.31 | 4.23E+14 |
| 1.34 | 2.05E+14 |
| 1.79 | 1.17E+12 |

TABLE 1-continued

| μ [debye] | ρ [Ω · cm] |
|---|---|
| 1.84 | 3.43E+14 |
| 2.02 | 9.38E+13 |
| 2.06 | 4.06E+14 |
| 2.06 | 3.61E+13 |
| 2.07 | 1.51E+14 |
| 2.07 | 3.29E+13 |
| 2.17 | 1.23E+14 |
| 2.18 | 1.00E+14 |
| 2.54 | 1.78E+14 |
| 2.63 | 2.45E+13 |
| 2.64 | 5.42E+12 |
| 2.69 | 2.29E+13 |
| 2.83 | 5.34E+13 |
| 2.93 | 2.90E+12 |
| 2.97 | 9.48E+11 |
| 2.97 | 1.40E+12 |
| 3.20 | 2.62E+11 |
| 3.28 | 9.58E+12 |
| 3.30 | 1.99E+11 |
| 3.39 | 1.77E+13 |
| 3.40 | 1.25E+13 |
| 3.41 | 1.03E+13 |
| 3.59 | 4.36E+12 |
| 3.61 | 5.79E+12 |
| 3.64 | 3.77E+11 |
| 3.87 | 4.12E+09 |
| 3.91 | 7.35E+12 |
| 3.96 | 2.37E+11 |
| 4.13 | 1.06E+13 |
| 4.38 | 1.63E+11 |
| 4.61 | 9.56E+11 |
| 6.76 | 1.39E+12 |
| 7.90 | 4.24E+11 |
| 9.17 | 1.95E+10 |
| 9.39 | 3.96E+10 |

For measurement of the values in Table 1, a mother liquid crystal and an additive material added to the mother liquid crystal are mixed to form the liquid crystal layer. The dipole moment ρ is a dipole moment of a molecule of the additive material. The resistivities μ shown in Table 1 are resistivities of the liquid crystal layer, i.e., a mixture of the mother liquid crystal and the additive material. As for a mixing ratio of the mother liquid crystal and the additive material, the ratio of the additive material to the entire mixed material is 20 weight %. Hereinafter, the mixture of the mother liquid crystal and the additive material is referred to as a mixed liquid crystal. Data shown in Table 1 shows the relationship between the dipole moment of a molecule contained in an additive material and the resistivity of a mixed liquid crystal to which the additive material is added, which is obtained by changing kinds of additive material added to the mother liquid crystal.

As shown in Table 1, the resistivity of the mixed liquid crystal is increased with the decrease in the dipole moment of the molecule of the additive material. In other words, the resistivity is decreased as the dipole moment of the additive material is increased. According to Table 1, the resistivity of a mixed liquid crystal whose molecule of the additive material has a dipole moment of less than or equal to 3 debye is higher than or equal to $1.0\times10^{14}$ Ω·cm. The resistivity is increased as the dipole moment of the molecule of the additive material is decreased. However, the minimum dipole moment of zero is a state with no deviation of electric charges of a molecule. For example, when the molecule structure is symmetric with respect to the center of the molecule, there is no distribution deviation of electric charges and thus the dipole moment is zero. For this reason, in the liquid crystal material included in the liquid crystal element of one embodiment of the present invention, the eternal dipole moment of the molecule of the additive material is preferably greater than or equal to 0 debye and less than or equal to 3 debye. The resistivity is preferably higher than or equal to $1.0\times10^{14}$ Ω·cm.

<Description of Relationship Between Dipole Moment and Operation of Liquid Crystal Layer>

Here, the dipole moment is described. In a molecule consisting of different kinds of atoms, the electronegativity of each atom generally differs from each other. When the atoms are combined to be a molecule, a distribution deviation of electric charges occurs in the molecule due to the difference in electronegativity. The dipole moment quantitatively represents the degree of the deviation. Note that the deviation of electric charges in the molecule can be represented as the presence of the eternal dipole moment.

When the deviation of electric charges is schematically represented as a state in which dot electric charges +q and −q having different polarities are separated by a distance l. In that case, the dipole moment is the product ql. The unit is C·m (coulomb meter) denoting the product of electric charges and the length.

The dipole moment is expressed as "debye" conventionally. In some cases, "debye" is represented as "debye unit" or "debye" or is represented as an alphabet "D" or "DU". Formula 1 shows the relationship between debye and SI unit. As is found from Formula 1, debye represented by SI unit is extremely small. In general, a dipole moment of a molecule is approximately 1 debye. Therefore, the debye unit is generally used to represent the size of the dipole moment. The size of the dipole moment is represented by debye in this specification as well, and can be converted into SI unit using the relational expression of Formula 1.

[Formula 1]

$$1\ \text{debye}=3.33564\times10^{-30}\ [\text{C}\cdot\text{m}] \quad (1)$$

As for the liquid crystal layer, a molecule included in the liquid crystal layer (hereinafter referred to as a liquid crystal molecule) is a compound obtained by a combination of a plurality of different atoms. Thus, the liquid crystal layer has a distribution deviation of electric charges in the liquid crystal molecule, and has a dipole moment.

The liquid crystal molecule of the liquid crystal layer which is suitable for a display device generally has a stick-like shape. The liquid crystal layer is a dielectric having a dielectric anisotropy in which the dielectric constant is changed depending on the orientation direction of the stick-form liquid crystal molecules.

An electron-withdrawing group and an electron-donating group, such as cyano and halogen, in the molecule are related to the expression of dielectric anisotropy. The dielectric anisotropy is a property that has a direct relation to the response operation of a liquid crystal molecule with respect to an external field such as an electric field. A molecule structure showing a strong dielectric anisotropy is selected appropriately. However, when the number of electron-withdrawing groups is increased, for example, to increase the dielectric anisotropy, the deviation of electric charges, that is, the dipole moment becomes too large. As a result, the liquid crystal layer easily absorbs ionic impurities.

When the concentration of ionic impurities in the liquid crystal layer is increased, ion conduction easily occurs in the liquid crystal layer, so that the voltage holding ratio of the liquid crystal layer is reduced. Moreover, electric charges arisen from the ionic impurities are built up on the surface of the liquid crystal layer. This becomes a cause of an increase in the residual DC which appears when voltage is generated in the liquid crystal layer. The amount of the residual DC serves as a measure of possibility of the image burn-in of the display device and thus is preferably small.

The ionic impurities can enter at various steps, such as the material synthesizing step and the panel fabricating step. It is needless to say to avoid impurity contamination in each step. Moreover, the reduction of impurity ions in the material itself is effective in increasing the voltage holding ratio of the liquid crystal layer and in reducing the residual DC. Therefore, the material is preferably selected so that each liquid crystal molecule can have a small dipole moment.

As described above, when the dipole moment of the molecule exceeds 3, the influence of impurities contained in the liquid crystal layer becomes significant. The impurity that remains in the liquid crystal layer decreases the resistivity of the liquid crystal layer and increases the conductivity of the liquid crystal layer. This makes it difficult to keep voltage which has been applied to a pixel when the refresh rate of the display device is lowered.

When the dipole moment of the molecule contained in the liquid crystal layer is small, the amount of impurities in the liquid crystal layer can be reduced, so that the liquid crystal layer can have a low conductivity. For this reason, the liquid crystal layer whose molecule has a small dipole moment has an advantage in that voltage applied to a pixel can be kept longer when the refresh rate is low.

However, a simple reduction in dipole moment of the molecule of the liquid crystal layer may lead to a tendency to lower the interaction with an electric field. In that case, the behavior of the liquid crystal layer is slow; thus, the driving voltage needs to be set higher to facilitate high-speed operation. For this reason, this structure is not suitable for a liquid crystal layer with lower refresh rate for the purpose of low power consumption.

In particular, high driving voltage is not preferable because the total power consumption of the liquid crystal display device significantly increases when driving at a low refresh rate is changed to driving at a higher refresh rate for displaying moving images.

Therefore, it is preferable in one mode of this embodiment that the dipole moment of the molecule contained in the liquid crystal layer be greater than or equal to 0 debye and less than or equal to 3 debye. The liquid crystal layer whose molecule has a dipole moment of greater than or equal to 0 debye and less than or equal to 3 debye can reduce the proportion of the impurity contained in the liquid crystal layer and does not increase power consumption when moving image display is performed. Thus, driving voltage of the liquid crystal layer can be set in a preferable range.

Note that when the dipole moment of the molecule contained in the liquid crystal layer is greater than or equal to 0 debye and less than or equal to 3 debye, the driving voltage of the liquid crystal layer is preferably set high within a range without an increase in power consumption. A high driving voltage of the liquid crystal layer broadens an acceptable range of a deviation in grayscale. In other words, flickers can be reduced owing to the high driving voltage and a small deviation in grayscale in accordance with a change in voltage.

Note that the dipole moment of the molecule contained in the liquid crystal layer is greater than or equal to 0 debye and less than or equal to 3 debye in the description above, and is preferably greater than or equal to 0 debye and less than or equal to 2.5 debye, further preferably greater than or equal to 0 debye and less than or equal to 1.8 debye.

Note that the liquid crystal layer described in this embodiment is a liquid crystal layer in a TN (twisted nematic) mode as an example, but other modes can be employed.

As an operation mode of the liquid crystal layer other than the TN mode, an ECB (electrically controlled birefringence) mode, an IPS (in-plane-switching) mode, an FFS (fringe field switching) mode, an MVA (multi-domain vertical alignment) mode, a PVA (patterned vertical alignment) mode, an ASM (axially symmetric aligned micro-cell) mode, an OCB (optical compensated birefringence) mode, an FLC (ferroelectric liquid crystal) mode, an AFLC (antiferroelectric liquid crystal) mode, or the like can be used. Note that the structure of a pixel electrode in each pixel in the display device can be changed as appropriate in accordance with the display mode.

<Description of Voltage Holding Ratio>

Described here is the relation between the dipole moment of a molecule contained in the liquid crystal layer which is greater than or equal to 0 debye and less than or equal to 3 debye and the voltage holding ratio of the liquid crystal layer. For the voltage holding ratio, calculated was an area ratio with a voltage held after a voltage of 3 V is applied to electrodes with the liquid crystal layer interposed therebetween for 16.6 ms and the electrodes are open-circuited.

The voltage holding ratio of a material in which the dipole moment is not devised was 98.0% after a lapse of 30 seconds, whereas the voltage holding ratio of a material in which the dipole moment is greater than or equal to 0 debye and less than or equal to 3 debye was improved to 98.8% after a lapse of 30 seconds.

This embodiment can be combined with any of the other embodiments as appropriate.

Embodiment 3

In this embodiment, a structure example of a display device including a reflective display element and a light-emitting display element is described. Note that a structure example of a display device including a liquid crystal element as the reflective display element and including a light-emitting element with an EL material as the light-emitting display element is described in this embodiment.

Figure 10A:
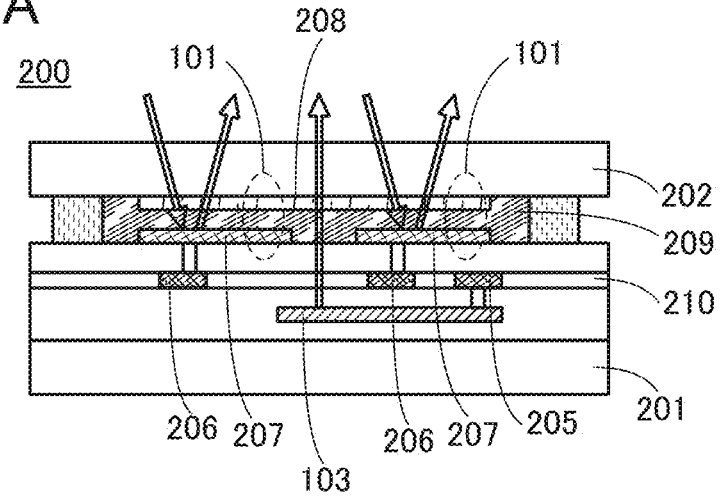
FIGS. 10A and 10B shows structure examples of a display device.

FIG. 10A illustrates an example of a cross-sectional structure of a display device 200 in one embodiment of the present invention. The display device 200 in FIG. 10A includes a display element 103 as the light-emitting display element, a display element 101 as the reflective display element, a transistor 205 having a function of controlling a current supply to the display element 103, and a transistor 206 having a function of controlling a voltage supply to the display element 101. The display element 103, the display element 101, the transistor 205, and the transistor 206 are positioned between a substrate 201 and a substrate 202. A liquid crystal element is used as the display element 101.

In the display device 200, the display element 101 includes a pixel electrode 207, a common electrode 208, and a liquid crystal layer 209. The pixel electrode 207 is electrically connected to the transistor 206. The alignment of the liquid crystal layer 209 is controlled with a voltage applied between the pixel electrode 207 and the common electrode 208. Note that FIG. 10A illustrates an example where the pixel electrode 207 has a function of reflecting visible light and the common electrode 208 has a function of transmitting visible light. Light entering through the substrate 202 is reflected by the pixel electrode 207 and exits through the substrate 202 again, as indicated by white arrows.

The display element 103 is electrically connected to the transistor 205. The display element 103 emits light to the substrate 202 side. Note that since FIG. 10A illustrates the example where the pixel electrode 207 has a function of reflecting visible light and the common electrode 208 has a function of transmitting visible light, light emitted from the display element 103 passes through a region which does not overlap with the pixel electrode 207, passes through a region where the common electrode 208 is located, and then exits through the substrate 202, as indicated by a white arrow.

In the display device 200 illustrated in FIG. 10A, the transistor 205 and the transistor 206 are located in the same layer 210, and the layer 210 including the transistor 205 and the transistor 206 includes a region positioned between the display element 101 and the display element 103. In the case where at least a semiconductor layer of the transistor 205 and a semiconductor layer of the transistor 206 are located on the same insulating surface, it can be said that the transistor 205 and the transistor 206 are included in the same layer 210.

Owing to the above structure, the transistor 205 and the transistor 206 can be manufactured through a common manufacturing process.

Figure 10B:
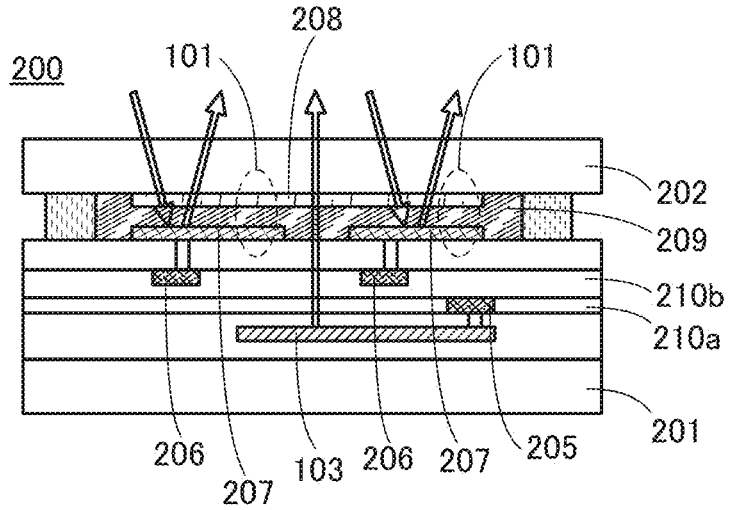

FIG. 10B illustrates an example of a cross-sectional structure of another display device 200 in one embodiment of the present invention. The structure of the display device 200 in FIG. 10B differs from that of the display device 200 in FIG. 10A in that the transistor 205 and the transistor 206 are included in different layers.

Specifically, the display device 200 in FIG. 10B includes a layer 210*a* which includes the transistor 205 and a layer 210*b* which includes the transistor 206, and the layer 210*a* and the layer 210*b* each include a region positioned between the display element 101 and the display element 103. In the display device 200 illustrated in FIG. 10B, the layer 210*a* is closer to the display element 103 than the layer 210*b* is. In the case where at least a semiconductor layer of the transistor 205 and a semiconductor layer of the transistor 206 are located on different insulating surfaces, it can be said that the transistor 205 and the transistor 206 are included in different layers.

Owing to the above structure, the transistor 205 and a variety of wirings electrically connected to the transistor 205 can partly overlap with the transistor 206 and a variety of wirings electrically connected to the transistor 206. Thus, the size of the pixel can be decreased, and the resolution of the display device 200 can be increased.

Figure 11A:
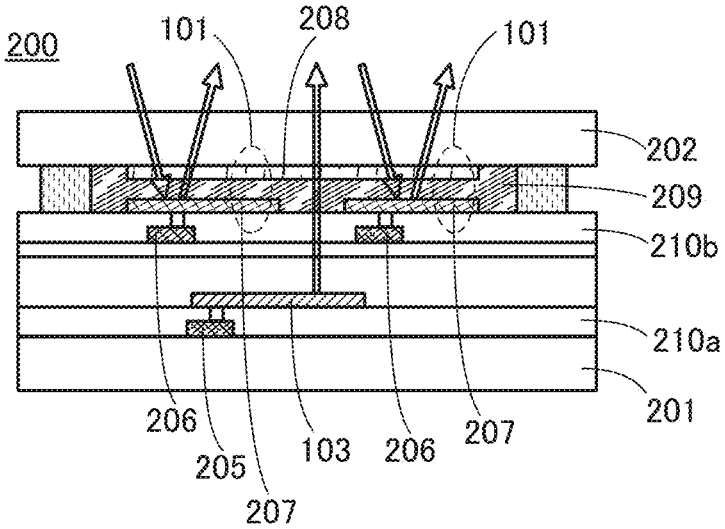
FIGS. 11A and 11B show structure examples of a display device.

FIG. 11A illustrates an example of a cross-sectional structure of another display device 200 in one embodiment of the present invention. The structure of the display device 200 in FIG. 11A differs from that of the display device 200 in FIG. 10A in that the transistor 205 and the transistor 206 are included in different layers. In addition, the structure of the display device 200 illustrated in FIG. 11A differs from that of the display device 200 in FIG. 10B in that the layer 210*a* including the transistor 205 is closer to the substrate 201 than the display element 103 is.

Specifically, the display device 200 in FIG. 11A includes the layer 210*a* which includes the transistor 205 and the layer 210*b* which includes the transistor 206. The layer 210*a* includes a region positioned between the display element 103 and the substrate 201. The layer 210*b* includes a region positioned between the display element 101 and the display element 103.

Owing to the above structure, the transistor 205 and a variety of wirings electrically connected to the transistor 205 can overlap with the transistor 206 and a variety of wirings electrically connected to the transistor 206, to a larger extent than in the case of FIG. 10B. Thus, the size of the pixel can be decreased, and the resolution of the display device 200 can be increased.

Figure 11B:
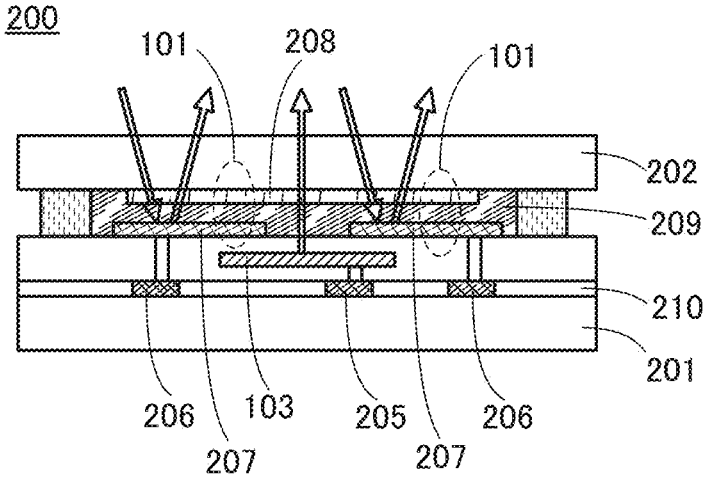

FIG. 11B illustrates an example of a cross-sectional structure of another display device 200 in one embodiment of the present invention. The structure of the display device 200 in FIG. 11B is the same as that of the display device 200 in FIG. 10A in that the transistor 205 and the transistor 206 are included in the same layer. However, the structure of the display device 200 illustrated in FIG. 11B differs from that of the display device 200 in FIG. 10A in that the layer including the transistor 205 and the transistor 206 is closer to the substrate 201 than the display element 103 is.

Specifically, the display device 200 in FIG. 11B includes the layer 210 which includes the transistor 205 and the transistor 206. The layer 210 includes a region positioned between the display element 103 and the substrate 201. The display element 101 is closer to the substrate 202 than the display element 103 is.

Owing to the above structure, the transistor 205 and the transistor 206 can be manufactured through a common manufacturing process. A wiring which electrically connects the display element 101 and the transistor 206 and a wiring which electrically connects the display element 103 and the transistor 205 can be provided on the same side of the layer 210. Specifically, the wiring which electrically connects the display element 101 and the transistor 206 can be formed over the semiconductor layer of the transistor 206, and the wiring which electrically connects the display element 103 and the transistor 205 can be formed over the semiconductor layer of the transistor 205. Thus, the manufacturing process can be simpler than that of the display device 200 illustrated in FIG. 10A.

Note that FIGS. 10A and 10B and FIGS. 11A and 11B each illustrate the cross-sectional structure in which one display element 103 is provided with respect to two display elements 101. However, the display device in one embodiment of the present invention may have a cross-sectional structure in which one display element 103 is provided with respect to one display element 101, or may have a cross-sectional structure in which a plurality of display elements 103 is provided with respect to one display element 101.

Although FIGS. 10A and 10B and FIGS. 11A and 11B each illustrate the example where the pixel electrode 207 of the display element 101 has a function of reflecting visible light, the pixel electrode 207 may have a function of transmitting visible light. In that case, a light source such as a backlight or a frontlight may be provided in the display device 200, or the display element 103 may be used as a light source when an image is displayed using the display element 101.

This embodiment can be implemented in appropriate combinations with any of the other embodiments.

Embodiment 4

In this embodiment, a structure example of a pixel of a display device including a reflective display element and a light-emitting display element is described. Note that a structure example of a pixel 300 of one embodiment of the present invention in the case of including a liquid crystal element as the reflective display element and including a light-emitting element with an EL material as the light-emitting display element is described in this embodiment.

Figure 12A:
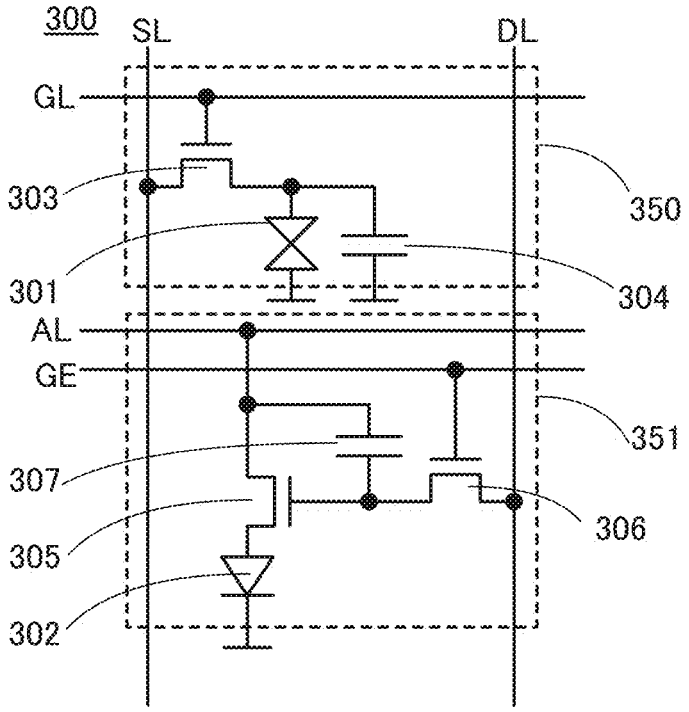
FIGS. 12A and 12B show configuration examples of pixels of a display device.

The pixel 300 illustrated in FIG. 12A includes a pixel 350 and a pixel 351. The pixel 350 includes a liquid crystal element 301, and the pixel 351 includes a light-emitting element 302. The display element 101 and the display element 103 described in the above embodiment can be used as the liquid crystal element 301 and the light-emitting element 302, respectively.

Specifically, the pixel 350 includes the liquid crystal element 301, a transistor 303 having a function of controlling a voltage to be applied to the liquid crystal element 301, and a capacitor 304. A gate of the transistor 303 is electrically connected to a wiring GL, one of a source and a drain thereof is electrically connected to a wiring SL, and the other of the source and the drain thereof is electrically connected to a pixel electrode of the liquid crystal element 301. A common electrode of the liquid crystal element 301 is electrically connected to a wiring or an electrode to which a predetermined potential is supplied. One electrode of the capacitor 304 is electrically connected to the pixel electrode of the liquid crystal element 301, and the other electrode thereof is electrically connected to a wiring or an electrode to which a predetermined potential is supplied.

Specifically, the pixel 351 includes the light-emitting element 302, a transistor 305 having a function of controlling a current to be supplied to the light-emitting element 302, a transistor 306 having a function of controlling a potential supply to a gate of the transistor 305, and a capacitor 307. A gate of the transistor 306 is electrically connected to a wiring GE, one of a source and a drain thereof is electrically connected to a wiring DL, and the other of the source and the drain thereof is electrically connected to the gate of the transistor 305. One of a source and a drain of the transistor 305 is electrically connected to a wiring AL, and the other of the source and the drain thereof is electrically connected to the light-emitting element 302. One electrode of the capacitor 307 is electrically connected to the wiring AL, and the other electrode thereof is electrically connected to the gate of the transistor 305.

In the pixel 300 illustrated in FIG. 12A, when an image signal for the liquid crystal element 301 is supplied to the wiring SL and an image signal for the light-emitting element 302 is supplied to the wiring DL, a grayscale of an image displayed by the liquid crystal element 301 and a grayscale of an image displayed by the light-emitting element 302 can be controlled separately.

Although FIG. 12A illustrates a structure example of the pixel 300 which includes one pixel 350 with the liquid crystal element 301 and one pixel 351 with the light-emitting element 302, the pixel 300 may include a plurality of pixels 350 or a plurality of pixels 351.

Figure 12B:
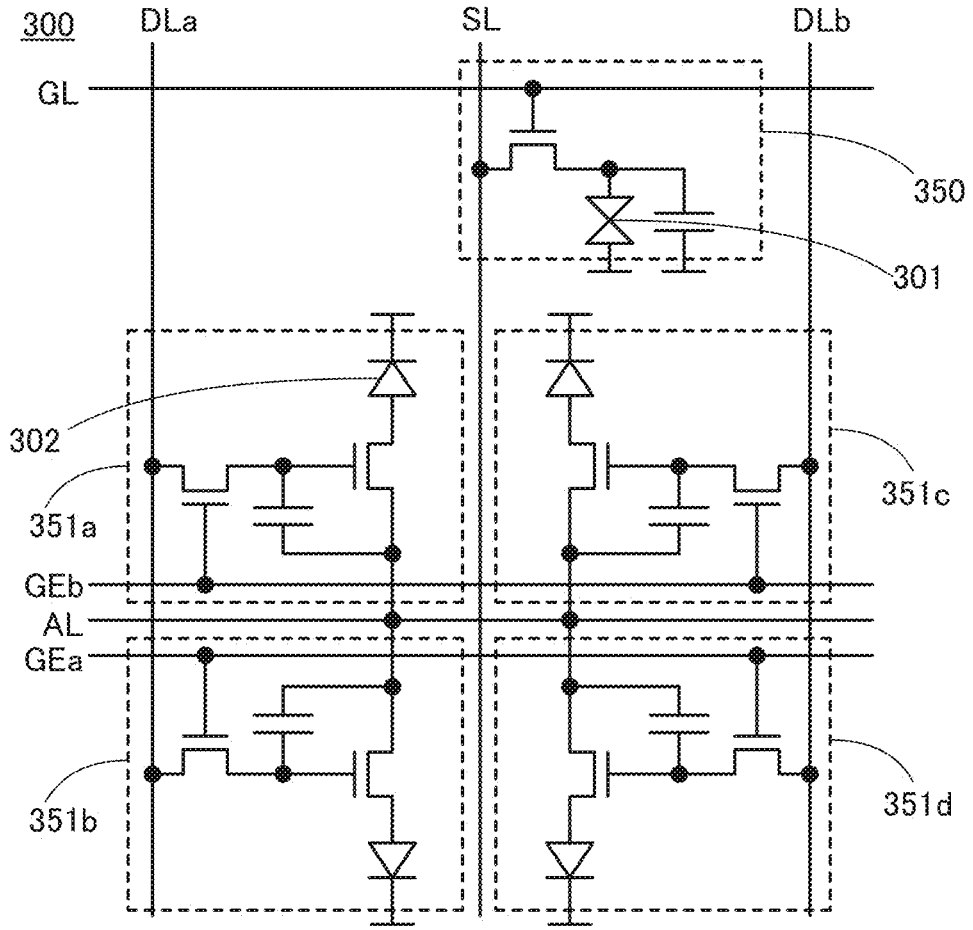

FIG. 12B illustrates a structure example of a pixel 300 which includes one pixel 350 and four pixels 351.

Specifically, the pixel 300 illustrated in FIG. 12B includes the pixel 350 with the liquid crystal element 301 and pixels 351*a* to 351*d* each with the light-emitting element 302.

For the structure of the pixel 350 in FIG. 12B, the structure of the pixel 350 in FIG. 12A can be referred to.

Like the pixel 351 in FIG. 12A, the pixels 351*a* to 351*d* in FIG. 12B each include the light-emitting element 302, the transistor 305 having a function of controlling a current to be supplied to the light-emitting element 302, the transistor 306 having a function of controlling a potential supply to the gate of the transistor 305, and the capacitor 307. The light-emitting elements 302 of the pixels 351*a* to 351*d* emit light having wavelengths in different ranges; thus, the display device can display a color image.

In the pixels 351*a* to 351*d* in FIG. 12B, a gate of the transistor 306 included in the pixel 351*a* and a gate of the transistor 306 included in the pixel 351*c* are electrically connected to a wiring GEb. A gate of the transistor 306 included in the pixel 351*b* and a gate of the transistor 306 included in the pixel 351*d* are electrically connected to a wiring GEa.

In the pixels 351*a* to 351*d* in FIG. 12B, one of a source and a drain of the transistor 306 included in the pixel 351*a* and one of a source and a drain of the transistor 306 included in the pixel 351*b* are electrically connected to a wiring DLa. One of a source and a drain of the transistor 306 included in the pixel 351*c* and one of a source and a drain of the transistor 306 included in the pixel 351*d* are electrically connected to a wiring DLb.

In the pixels 351*a* to 351*d* in FIG. 12B, one of a source and a drain of each of the transistors 305 is electrically connected to the wiring AL.

As described above, among the pixels 351*a* to 351*d* in FIG. 12B, the pixel 351*a* and the pixel 351*c* share the wiring GEb and the pixel 351*b* and the pixel 351*d* share the wiring GEa; however, all the pixels 351*a* to 351*d* may share one wiring GE. In that case, it is desired that the pixels 351*a* to 351*d* are electrically connected to four respective wirings DL.

Figure 13A:
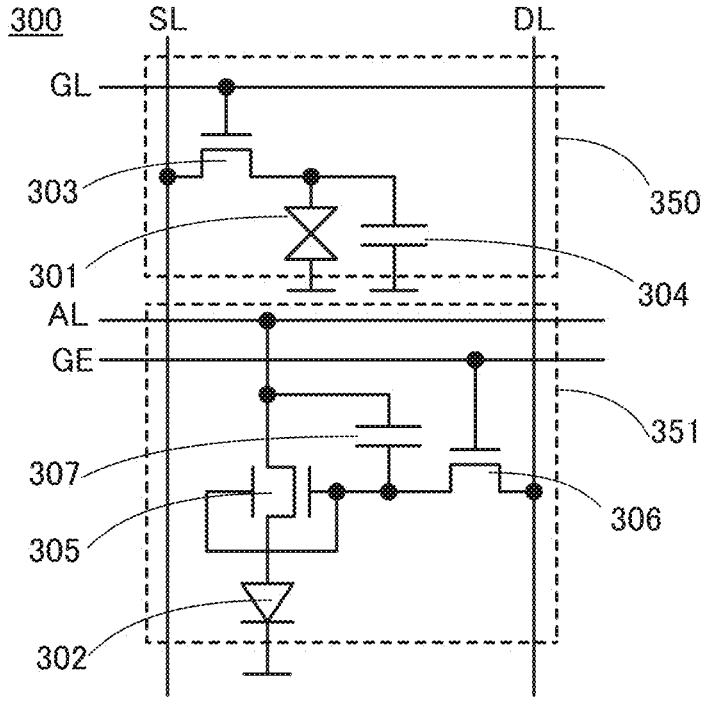
FIGS. 13A and 13B show configuration examples of pixels of a display device.

FIG. 13A illustrates a structure example of the pixel 300 which is different from that in FIG. 12A. The structure of the pixel 300 in FIG. 13A differs from that of the pixel 300 in FIG. 12A in that the transistor 305 included in the pixel 351 includes a back gate.

Specifically, in the pixel 300 illustrated in FIG. 13A, the back gate of the transistor 305 is electrically connected to the gate (front gate) thereof. In the pixel 300 in FIG. 13A with the above structure, a shift of the threshold voltage of the transistor 305 can be reduced, and the reliability of the transistor 305 can be improved. In addition, in the pixel 300 in FIG. 13A with the above structure, the size of the transistor 305 can be reduced, and the on-state current of the transistor 305 can be increased.

Note that in the display device of one embodiment of the present invention, the pixel 300 may include a plurality of pixels 350 illustrated in FIG. 13A or a plurality of pixels 351 illustrated in FIG. 13A. Specifically, like the pixel 300 in FIG. 12B, the pixel 300 may include one pixel 350 and four pixels 351 illustrated in FIG. 13A. In that case, for connections of a variety of wirings and the four pixels 351, the pixel 300 in FIG. 12B can be referred to.

Figure 13B:
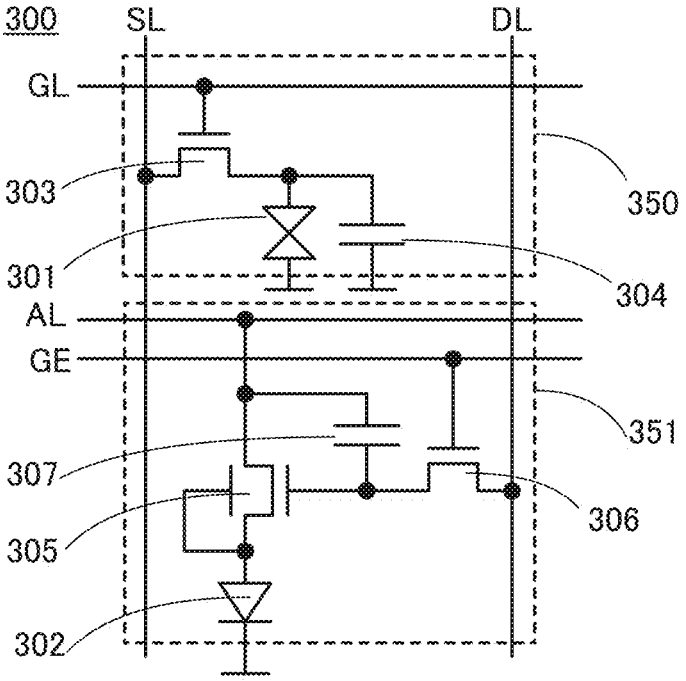

FIG. 13B illustrates a structure example of the pixel 300 which is different from that in FIG. 12A. The structure of the pixel 300 in FIG. 13B differs from that of the pixel 300 in FIG. 12A in that the transistor 305 included in the pixel 351 includes a back gate. In addition, the structure of the pixel 300 in FIG. 13B differs from that of the pixel 300 in FIG. 13A in that the back gate of the transistor 305 is electrically connected to not the gate thereof but the light-emitting element 302.

In the pixel 300 in FIG. 13B with the above structure, a shift of the threshold voltage of the transistor 305 can be reduced, and the reliability of the transistor 305 can be improved.

Note that in the display device of one embodiment of the present invention, the pixel 300 may include a plurality of pixels 350 illustrated in FIG. 13B or a plurality of pixels 351 illustrated in FIG. 13B. Specifically, like the pixel 300 in FIG. 12B, the pixel 300 may include one pixel 350 and four pixels 351 illustrated in FIG. 13B. In that case, for connections of a variety of wirings and the four pixels 351, the pixel 300 in FIG. 12B can be referred to.

Figure 14:
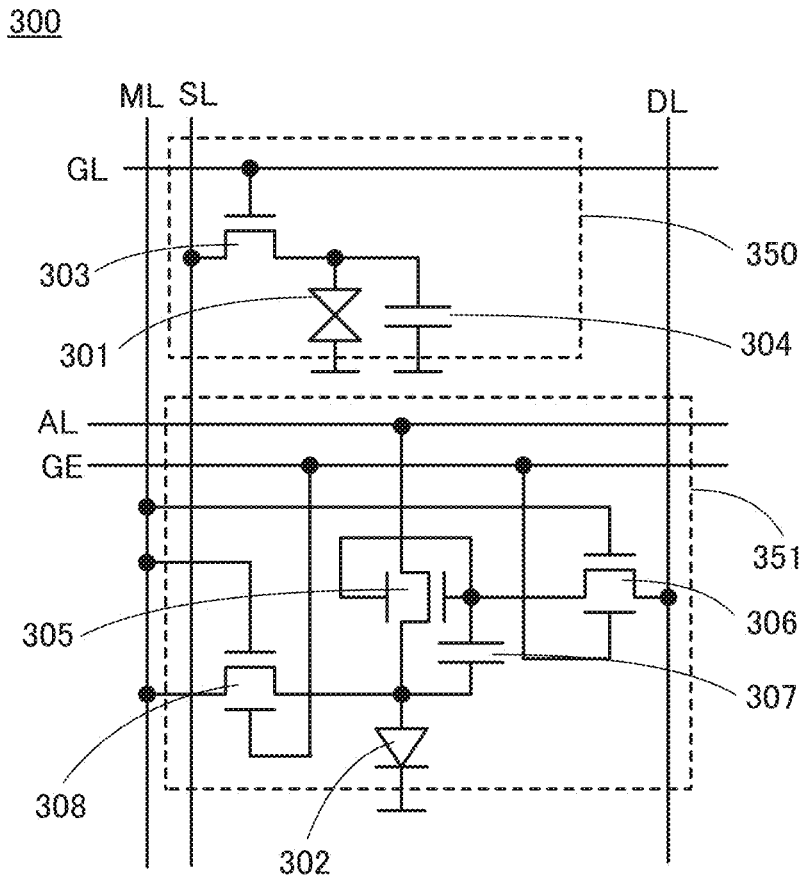
FIG. 14 shows a configuration example of pixels of a display device.

FIG. 14 illustrates a structure example of the pixel 300 which is different from that in FIG. 12A. The pixel 300 in FIG. 14 includes the pixel 350 and the pixel 351, and the structure of the pixel 351 differs from that in FIG. 12A.

Specifically, the pixel 351 in FIG. 14 includes the light-emitting element 302, the transistor 305 having a function of controlling a current to be supplied to the light-emitting element 302, the transistor 306 having a function of controlling a potential supply to the gate of the transistor 305, a transistor 308 having a function of supplying a predetermined potential to the pixel electrode of the light-emitting element 302, and the capacitor 307. The transistor 305, the transistor 306, and the transistor 308 each include a back gate.

A gate (a front gate) of the transistor 306 is electrically connected to a wiring ML, the back gate thereof is electrically connected to the wiring GE, one of a source and a drain thereof is electrically connected to the wiring DL, and the other of the source and the drain thereof is electrically connected to the gate and the back gate of the transistor 305. One of a source and a drain of the transistor 305 is electrically connected to the wiring AL, and the other of the source and the drain thereof is electrically connected to the light-emitting element 302. A gate (a front gate) of the transistor 308 is electrically connected to the wiring ML, the back gate thereof is electrically connected to the wiring GE, one of a source and a drain thereof is electrically connected to the wiring ML, and the other of the source and the drain thereof is electrically connected to the light-emitting element 302. One electrode of the capacitor 307 is electrically connected to the wiring AL, and the other electrode thereof is electrically connected to the gate of the transistor 305.

Although FIG. 14 illustrates a structure example of the pixel 300 which includes one pixel 350 with the liquid crystal element 301 and one pixel 351 with the light-emitting element 302, the pixel 300 may include a plurality of pixels 350 or a plurality of pixels 351.

Figure 15:
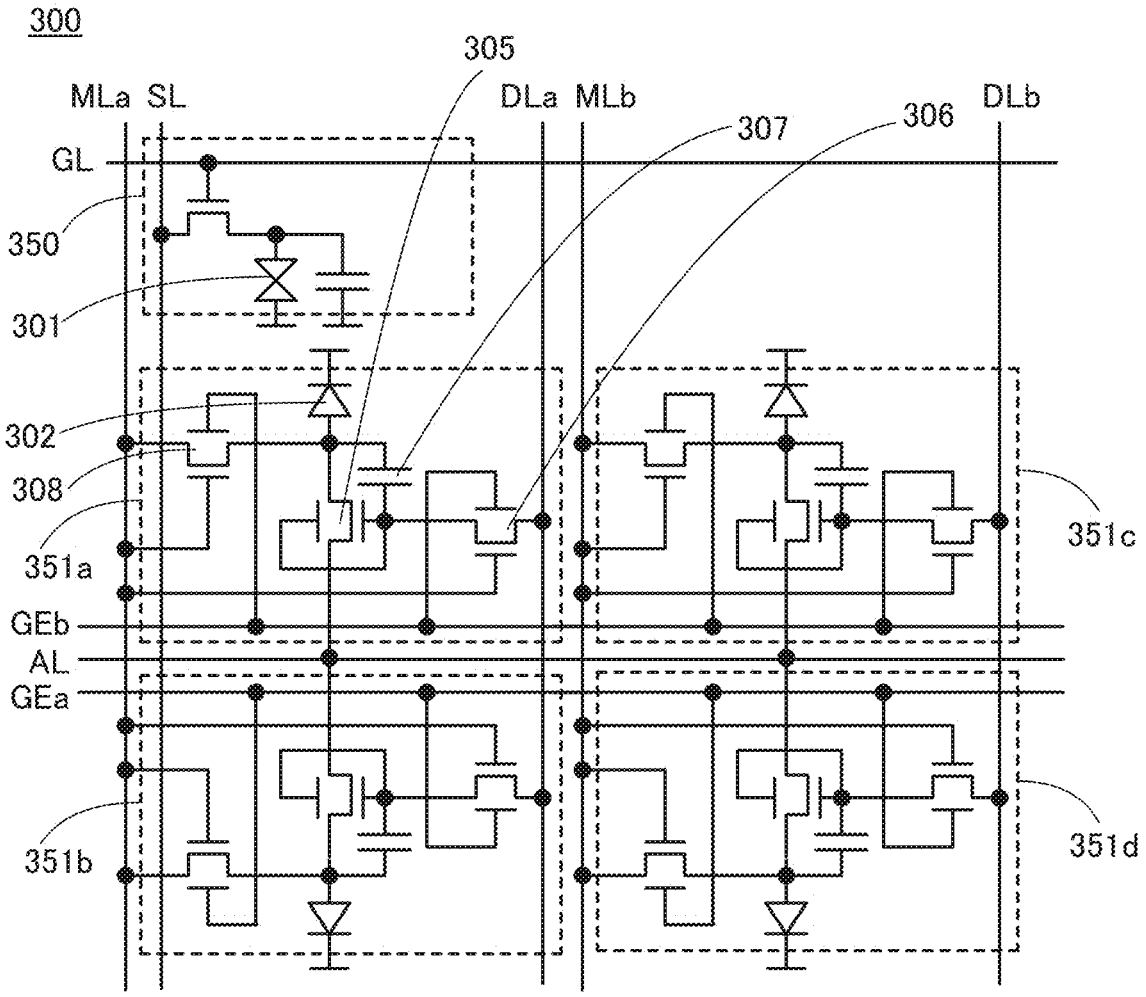
FIG. 15 shows a configuration example of pixels of a display device.

FIG. 15 illustrates a structure example of the pixel 300 which includes one pixel 350 and four pixels 351.

Specifically, the pixel 300 illustrated in FIG. 15 includes the pixel 350 with the liquid crystal element 301 and pixels 351*a* to 351*d* each with the light-emitting element 302.

For the structure of the pixel 350 in FIG. 15, the structure of the pixel 350 in FIG. 14 can be referred to.

Like the pixel 351 in FIG. 14, the pixels 351*a* to 351*d* in FIG. 15 each include the light-emitting element 302, the transistor 305 having a function of controlling a current to be supplied to the light-emitting element 302, the transistor 306 having a function of controlling a potential supply to the gate of the transistor 305, the transistor 308 having a function of supplying a predetermined potential to the pixel electrode of the light-emitting element 302, and the capacitor 307. The light-emitting elements 302 of the pixels 351*a* to 351*d* emit light having wavelengths in different ranges; thus, the display device can display a color image.

In the pixels 351*a* to 351*d* in FIG. 15, a gate of the transistor 306 included in the pixel 351*a* and a gate of the transistor 306 included in the pixel 351*b* are electrically connected to a wiring MLa. A gate of the transistor 306 included in the pixel 351*c* and a gate of the transistor 306 included in the pixel 351*d* are electrically connected to a wiring MLb.

In the pixels 351*a* to 351*d* in FIG. 15, a back gate of the transistor 306 included in the pixel 351*a* and a back gate of the transistor 306 included in the pixel 351*c* are electrically connected to a wiring GEb. A back gate of the transistor 306 included in the pixel 351*b* and a back gate of the transistor 306 included in the pixel 351*d* are electrically connected to a wiring GEa.

In the pixels 351*a* to 351*d* in FIG. 15, one of a source and a drain of the transistor 306 included in the pixel 351*a* and one of a source and a drain of the transistor 306 included in the pixel 351*b* are electrically connected to a wiring DLa. One of a source and a drain of the transistor 306 included in the pixel 351*c* and one of a source and a drain of the transistor 306 included in the pixel 351*d* are electrically connected to a wiring DLb.

In the pixels 351*a* to 351*d* in FIG. 15, a back gate of the transistor 308 included in the pixel 351*a* and a back gate of the transistor 308 included in the pixel 351*c* are electrically connected to the wiring GEb. A back gate of the transistor 308 included in the pixel 351*b* and a back gate of the transistor 308 included in the pixel 351*d* are electrically connected to the wiring GEa.

In the pixels 351*a* to 351*d* in FIG. 15, a gate and one of a source and a drain of the transistor 308 included in the pixel 351*a* are electrically connected to the wiring MLa, and a gate and one of a source and a drain of the transistor 308 included in the pixel 351*b* are electrically connected to the wiring MLa. A gate and one of a source and a drain of the transistor 308 included in the pixel 351*c* are electrically connected to the wiring MLb, and a gate and one of a source and a drain of the transistor 308 included in the pixel 351*d* are electrically connected to the wiring MLb.

In the pixels 351*a* to 351*d* in FIG. 15, one of a source and a drain of each of the transistors 305 is electrically connected to the wiring AL.

As described above, among the pixels 351*a* to 351*d* in FIG. 15, the pixel 351*a* and the pixel 351*c* share the wiring GEb and the pixel 351*b* and the pixel 351*d* share the wiring GEa; however, all the pixels 351*a* to 351*d* may share one wiring GE. In that case, it is desired that the pixels 351*a* to 351*d* are electrically connected to four respective wirings DL.

Note that in the case where a transistor with low off-state current is used in the pixel 350 and thus there is no need to rewrite the display screen (i.e., in the case of displaying a still image), a driver circuit can be temporarily stopped (this driving is hereinafter referred to "idling stop" or "IDS driving"). By IDS driving, the power consumption of the display device 200 can be reduced.

This embodiment can be implemented in appropriate combinations with any of the other embodiments.

Embodiment 5

Figure 16:
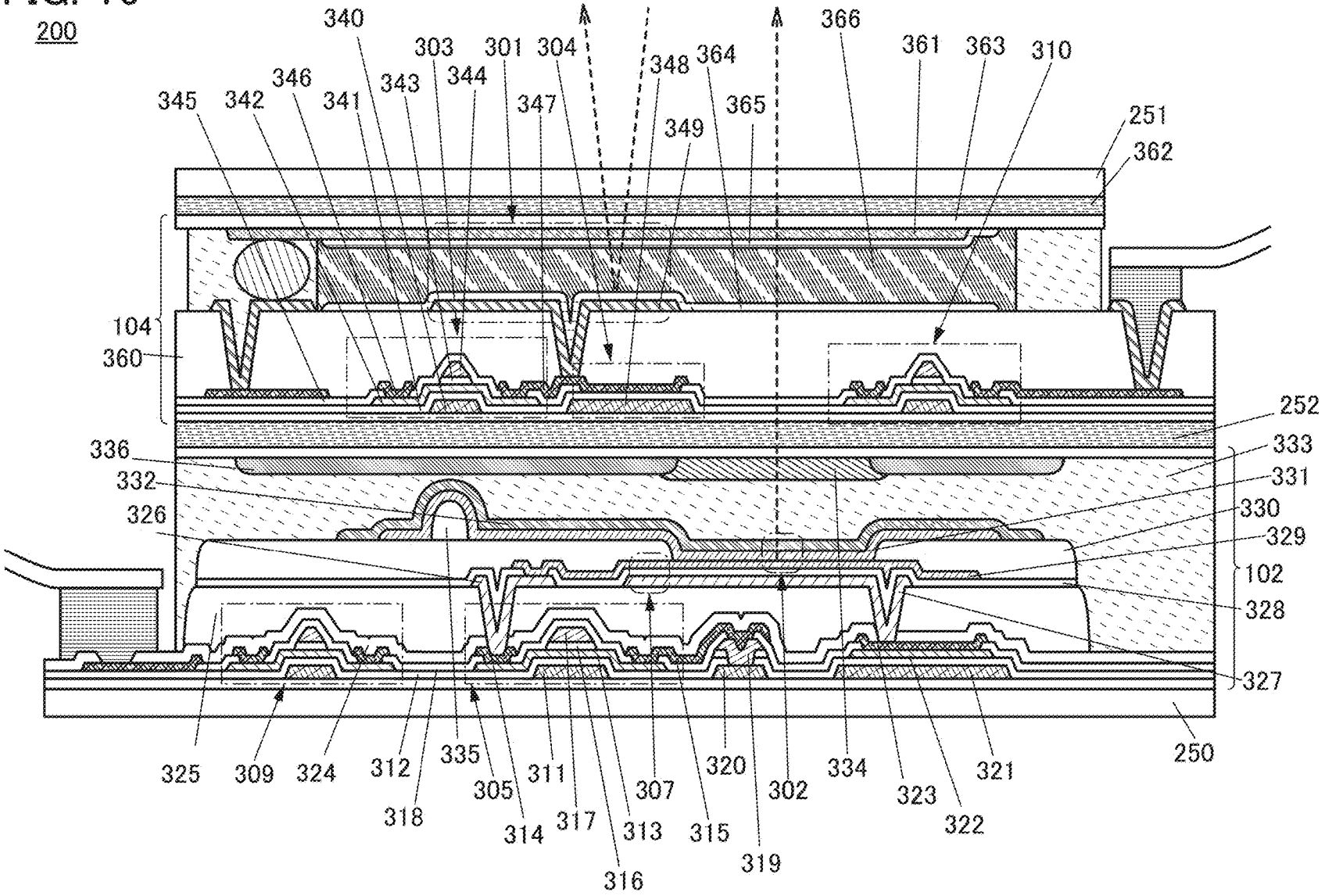
FIG. 16 illustrates an example of a cross-sectional structure of a display device.

In this embodiment, using the display device 200 illustrated in FIG. 4A as an example, a specific structure example of the display device 200 including a reflective display element and a light-emitting display element is described FIG. 16 illustrates an example of a cross-sectional structure of the display device 200.

The display device 200 illustrated in FIG. 16 has a structure in which a display portion 102 and a display portion 104 are stacked between a substrate 250 and a substrate 251. Specifically, the display portions 102 and 104 are bonded to each other with an adhesive layer 252 in FIG. 16.

FIG. 16 illustrates the light-emitting element 302, the transistor 305, and the capacitor 307, which are included in the pixel of the display portion 102, and the transistor 309 included in the driver circuit of the display portion 102. FIG. 16 also illustrates the liquid crystal element 301, the transistor 303, and the capacitor 304, which are included in the pixel of the display portion 104, and the transistor 310 included in the driver circuit of the display portion 104.

The transistor 305 includes a conductive layer 311 serving as a back gate; an insulating layer 312 over the conductive layer 311; a semiconductor layer 313 over the insulating layer 312, which overlaps with the conductive layer 311; an insulating layer 316 over the semiconductor layer 313; a conductive layer 317 which is positioned over the insulating layer 316 and serves as a gate; and a conductive layer 314 and a conductive layer 315 which are positioned over an insulating layer 318 positioned over the conductive layer 317 and electrically connected to the semiconductor layer 313.

The conductive layer 315 is electrically connected to a conductive layer 319, and the conductive layer 319 is electrically connected to a conductive layer 320. The conductive layer 319 is formed in the same layer as the conductive layer 317. The conductive layer 320 is formed in the same layer as the conductive layer 311.

A conductive layer 321 serving as a back gate of the transistor 306 (not illustrated) is positioned in the same layer as the conductive layers 311 and 320. The insulating layer 312 is positioned over the conductive layer 321, and a semiconductor layer 322 having a region overlapping with the conductive layer 321 is positioned over the insulating layer 312. The semiconductor layer 322 includes a channel formation region of the transistor 306 (not illustrated). The insulating layer 318 is positioned over the semiconductor layer 322, and a conductive layer 323 is positioned over the insulating layer 318. The conductive layer 323 is electrically connected to the semiconductor layer 322 and serves as a source electrode or a drain electrode of the transistor 306 (not illustrated).

The transistor 309 has the same structure as the transistor 305, and therefore, detailed description thereof is omitted.

An insulating layer 324 is positioned over the transistor 305, the conductive layer 323, and the transistor 309, and an insulating layer 325 is positioned over the insulating layer 324. A conductive layer 326 and a conductive layer 327 are positioned over the insulating layer 325. The conductive layer 326 is electrically connected to the conductive layer 314, and the conductive layer 327 is electrically connected to the conductive layer 323. An insulating layer 328 is positioned over the conductive layers 326 and 327, and a conductive layer 329 is positioned over the insulating layer 328. The conductive layer 329 is electrically connected to the conductive layer 326 and serves as a pixel electrode of the light-emitting element 302.

A region where the conductive layer 327, the insulating layer 328, and the conductive layer 329 overlap with each other serves as the capacitor 307.

An insulating layer 330 is positioned over the conductive layer 329, an EL layer 331 is positioned over the insulating layer 330, and a conductive layer 332 serving as a counter electrode is positioned over the EL layer 331. The conductive layer 329, the EL layer 331, and the conductive layer 332 are electrically connected to each other in an opening of the insulating layer 330. A region where the conductive layer 329, the EL layer 331, and the conductive layer 332 are electrically connected to each other serves as the light-emitting element 302. The light-emitting element 302 has a top emission structure in which light is emitted in a direction indicated by a dotted arrow from the conductive layer 332 side.

One of the conductive layers 329 and 332 serves as an anode, and the other serves as a cathode. When a voltage higher than the threshold voltage of the light-emitting element 302 is applied between the conductive layer 329 and the conductive layer 332, holes are injected to the EL layer 331 from the anode side and electrons are injected to the EL layer 331 from the cathode side. The injected electrons and holes are recombined in the EL layer 331 and a light-emitting substance contained in the EL layer 331 emits light.

Note that in the case where an oxide semiconductor is used for the semiconductor layers 313 and 322, it is preferable to use an insulating material containing oxygen for the insulating layer 318 and it is preferable to use a material through which impurities such as water and hydrogen do not easily diffuse for the insulating layer 324.

In the case where an organic material is used for the insulating layer 325 or 330, when the insulating layer 325 or 330 is exposed at an end portion of the display device, impurities such as water may enter the light-emitting element 302 and the like from the outside of the display device through the insulating layer 325 or 330. Deterioration of the light-emitting element 302 due to the entry of impurities can lead to deterioration of the display device. For this reason, the insulating layers 325 and 330 are preferably not positioned at the end portion of the display device, as illustrated in FIG. 16.

The light-emitting element 302 overlaps with a coloring layer 334 with an adhesive layer 333 provided therebetween. The spacer 335 overlaps with the light-blocking layer 336 with the adhesive layer 333 provided therebetween. Although FIG. 16 illustrates the case where a space is provided between the conductive layer 332 and the light-blocking layer 336, the conductive layer 332 and the light-blocking layer 336 may be in contact with each other.

The coloring layer 334 is a colored layer that transmits light in a specific wavelength range. For example, a color filter that transmits light in a specific wavelength range, such as red, green, blue, or yellow light, can be used.

Note that one embodiment of the present invention is not limited to a color filter method, and a separate coloring method, a color conversion method, a quantum dot method, and the like may be employed.

The transistor 303 in the display portion 104 includes a conductive layer 340 serving as a back gate; an insulating layer 341 over the conductive layer 340; a semiconductor layer 342 over the insulating layer 341, which overlaps with the conductive layer 340; an insulating layer 343 over the semiconductor layer 342; a conductive layer 344 which is positioned over the insulating layer 343 and serves as a gate; and a conductive layer 346 and a conductive layer 347 which are positioned over an insulating layer 345 positioned over the conductive layer 344 and electrically connected to the semiconductor layer 342.

A conductive layer 348 is positioned in the same layer as the conductive layer 340. The insulating layer 341 is positioned over the conductive layer 348, and the conductive layer 347 is positioned over the insulating layer 341 and in a region overlapping with the conductive layer 348. A region in which the conductive layer 347, the insulating layer 341, and the conductive layer 348 overlap with each other serves as the capacitor 304.

A transistor 310 has the same structure as the transistor 303, and thus, the detailed description is omitted.

An insulating layer 360 is positioned over the transistor 303, the capacitor 304, and the transistor 310, and a conductive layer 349 is positioned over the insulating layer 360. The conductive layer 349 is electrically connected to the conductive layer 347 and serves as a pixel electrode of the liquid crystal element 301. An alignment film 364 is positioned over the conductive layer 349.

A conductive layer 361 serving as a common electrode is positioned over the substrate 251. Specifically, in FIG. 16, an insulating layer 363 is bonded to the substrate 251 with an adhesive layer 362 interposed therebetween, and the conductive layer 361 is positioned over the insulating layer 363. An alignment film 365 is positioned over the conductive layer 361, and a liquid crystal layer 366 is positioned between the alignment film 364 and the alignment film 365.

In FIG. 16, the conductive layer 349 has a function of reflecting visible light, and the conductive layer 361 has a function of transmitting visible light. Thus light entering from the substrate 251 side can be reflected by the conductive layer 349 and emitted to the substrate 251 side as indicated by the dotted arrow.

For example, a material containing one of indium (In), zinc (Zn), and tin (Sn) is preferably used for the conductive material that transmits visible light. Specifically, indium oxide, indium tin oxide (ITO), indium zinc oxide, indium oxide containing tungsten oxide, indium zinc oxide containing tungsten oxide, indium oxide containing titanium oxide, indium tin oxide containing titanium oxide, indium tin oxide containing silicon oxide (ITSO), zinc oxide, and zinc oxide containing gallium are given, for example. Note that a film including graphene can be used as well. The film including graphene can be formed, for example, by reducing a film containing graphene oxide.

Examples of a conductive material that reflects visible light include aluminum, silver, and an alloy including any of these metal elements. Furthermore, a metal material such as gold, platinum, nickel, tungsten, chromium, molybdenum, iron, cobalt, copper, or palladium or an alloy containing any of these metal materials can be used. Furthermore, lanthanum, neodymium, germanium, or the like may be added to the metal material or the alloy. Furthermore, an alloy containing aluminum (an aluminum alloy) such as an alloy of aluminum and titanium, an alloy of aluminum and nickel, an alloy of aluminum and neodymium, or an alloy of aluminum, nickel, and lanthanum (Al—Ni—La); or an alloy containing silver such as an alloy of silver and copper, an alloy of silver, palladium, and copper (also referred to as Ag—Pd—Cu or APC), or an alloy of silver and magnesium may be used.

Note that although FIG. 16 illustrates a structure of the display device including a top-gate transistor including a back gate, the display device of one embodiment of the present invention may include a transistor not including a back gate or a transistor including a back gate.

There is no particular limitation on the crystallinity of a semiconductor material used for the transistor, and an amorphous semiconductor or a semiconductor having crystallinity (a microcrystalline semiconductor, a polycrystalline semiconductor, a single crystal semiconductor, or a semiconductor partly including crystal regions) may be used. A semiconductor having crystallinity is preferably used, in which case deterioration of the transistor characteristics can be suppressed.

As a semiconductor material used for the transistor, an oxide semiconductor can be used. Typically, an oxide semiconductor containing indium or the like can be used.

In particular, a semiconductor material having a wider band gap and a lower carrier density than silicon is preferably used because off-state current of the transistor can be reduced.

The semiconductor layer preferably includes, for example, a film represented by an In-M-Zn-based oxide that contains at least indium, zinc, and M (a metal such as aluminum, titanium, gallium, germanium, yttrium, zirconium, lanthanum, cerium, tin, neodymium, or hafnium). In order to reduce variations in electrical characteristics of the transistor including the oxide semiconductor, the oxide semiconductor preferably contains a stabilizer in addition to In and Zn.

Examples of the stabilizer, including metals that can be used as M, are gallium, tin, hafnium, aluminum, and zirconium. As another stabilizer, lanthanoid such as lanthanum, cerium, praseodymium, neodymium, samarium, europium, gadolinium, terbium, dysprosium, holmium, erbium, thulium, ytterbium, or lutetium can be given.

As an oxide semiconductor included in the semiconductor layer, any of the following can be used, for example: an In—Ga—Zn-based oxide, an In—Al—Zn-based oxide, an In—Sn—Zn-based oxide, an In—Hf—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn-based oxide, an In—Tb—Zn-based oxide, an In—Dy—Zn-based oxide, an In—Ho—Zn-based oxide, an In—Er—Zn-based oxide, an In—Tm—Zn-based oxide, an In—Yb—Zn-based oxide, an In—Lu—Zn-based oxide, an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, and an In—Hf—Al—Zn-based oxide.

Note that here, for example, an "In—Ga—Zn-based oxide" means an oxide containing In, Ga, and Zn as its main components and there is no limitation on the ratio of In:Ga:Zn. Further, a metal element in addition to In, Ga, and Zn may be contained.

Note that although the structure of the display device in which a liquid crystal element is used as a reflective display element is exemplified in this embodiment, a display element using a microcapsule method, an electrophoretic method, an electrowetting method, an Electronic Liquid Powder (registered trademark) method, or the like can also be used, other than micro electro mechanical systems (MEMS) shutter element or an optical interference type MEMS element.

As a light-emitting display element, a self-luminous light-emitting element such as an organic light-emitting diode (OLED), a light-emitting diode (LED), and a quantum-dot light-emitting diode (QLED) can be used.

The liquid crystal element can employ, for example, a vertical alignment (VA) mode. Examples of the vertical alignment mode include a multi-domain vertical alignment (MVA) mode, a patterned vertical alignment (PVA) mode, and an advanced super view (ASV) mode.

The liquid crystal element can employ a variety of modes; for example, other than the VA mode, a twisted nematic (TN) mode, an in-plane switching (IPS) mode, a fringe field switching (FFS) mode, an axially symmetric aligned micro-cell (ASM) mode, an optically compensated birefringence (OCB) mode, a ferroelectric liquid crystal (FLC) mode, or an antiferroelectric liquid crystal (AFLC) mode can be used.

As the liquid crystal used for the liquid crystal element, thermotropic liquid crystal, low-molecular liquid crystal, high-molecular liquid crystal, polymer dispersed liquid crystal (PDLC), ferroelectric liquid crystal, anti-ferroelectric liquid crystal, or the like can be used. These liquid crystal materials exhibit a cholesteric phase, a smectic phase, a cubic phase, a chiral nematic phase, an isotropic phase, or the like depending on conditions.

As the liquid crystal material, either a positive liquid crystal or a negative liquid crystal may be used, and an appropriate liquid crystal material can be used depending on the mode or design to be used.

An alignment film can be provided to adjust the alignment of a liquid crystal. In the case where a horizontal electric field mode is employed, a liquid crystal exhibiting a blue phase for which an alignment film is unnecessary may be used. The blue phase is a liquid crystal phase, which is generated just before a cholesteric phase changes into an isotropic phase when the temperature of a cholesteric liquid crystal is increased. Since the blue phase appears only in a narrow temperature range, a liquid crystal composition in which a chiral material is mixed to account for several weight percent or more is used for the liquid crystal layer in order to improve the temperature range. The liquid crystal composition containing a liquid crystal exhibiting a blue phase and a chiral material has a short response time and optical isotropy, which eliminates the need for an alignment process and reduces the viewing angle dependence. Since the alignment film does not need to be provided, rubbing treatment is not necessary; accordingly, electrostatic discharge damage caused by the rubbing treatment can be prevented, reducing defects and damage of a liquid crystal display device in the manufacturing process.

This embodiment can be combined with any of the other embodiments as appropriate.

Embodiment 6

Figure 17A:
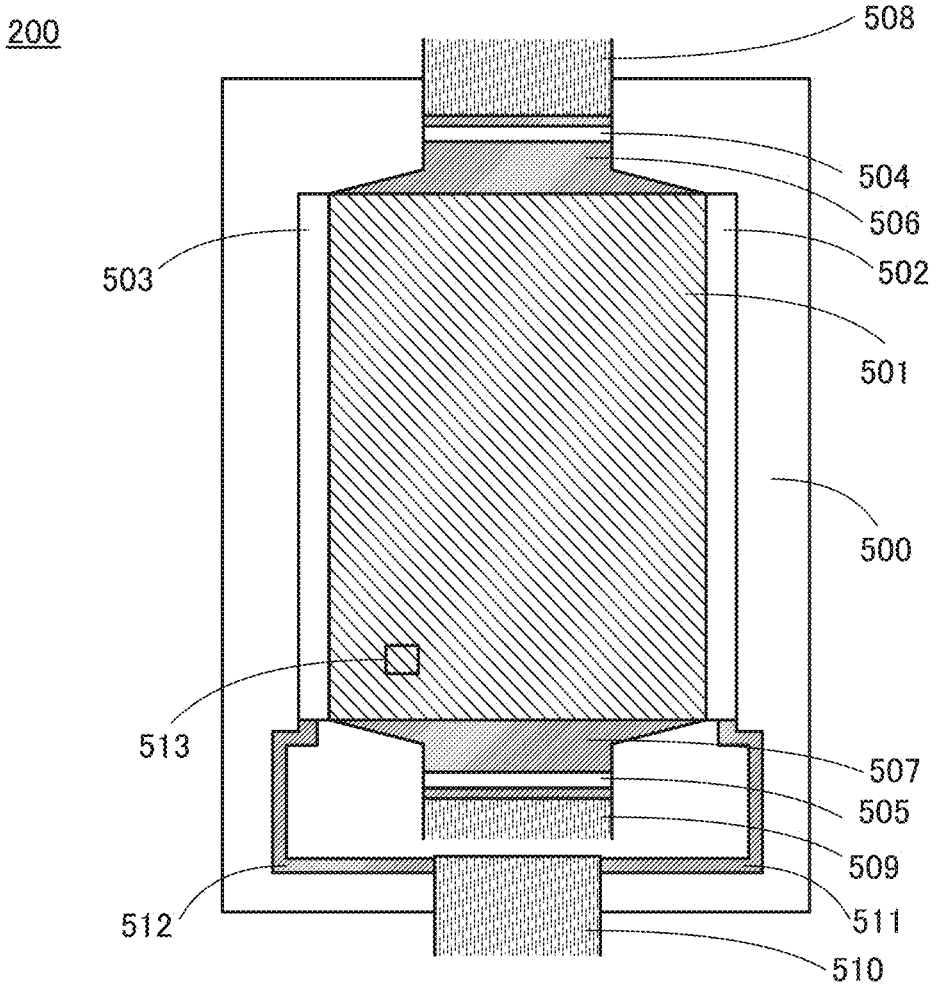
FIGS. 17A and 17B illustrate an example of the appearance of a display device.

FIG. 17A illustrates an example of the appearance of a display device 200 of one embodiment of the present invention. The display device 200 in FIG. 17A includes a pixel portion 501 over a substrate 500, a scan line driver circuit 502 for pixels including reflective display elements, and a scan line driver circuit 503 for pixels including light-emitting display elements. An IC 504 includes a signal line driver circuit for the pixels including reflective display elements, and is electrically connected to the pixel portion 501 through a wiring 506. An IC 505 includes a signal line driver circuit for the pixels including light-emitting display elements, and is electrically connected to the pixel portion 501 through a wiring 506.

An FPC 508 is electrically connected to the IC 504, and an FPC 509 is electrically connected to the IC 505. An FPC 510 is electrically connected to the scan line driver circuit 502 through a wiring 511. The FPC 510 is also electrically connected to the scan line driver circuit 503 through a wiring 512.

Figure 17B:
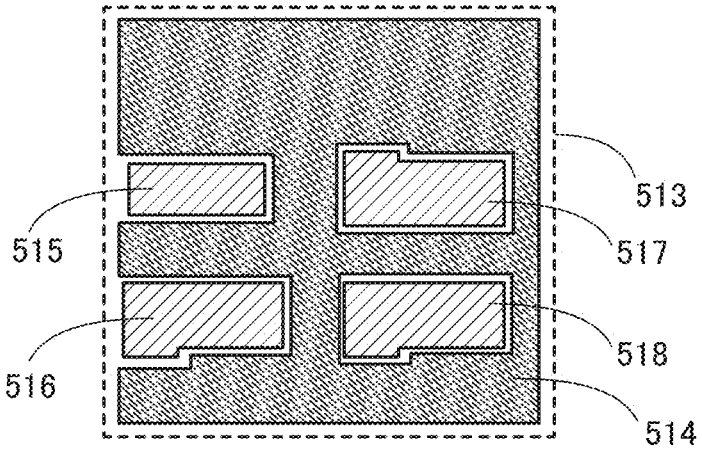

FIG. 17B illustrates a layout of a display region of a liquid crystal element and a layout of a display region of a light-emitting element in a pixel 513 included in the pixel portion 501 in the case where a liquid crystal element is used as the reflective display element and a light-emitting element is used as the light-emitting display element, for example.

Specifically, the pixel 513 in FIG. 17B includes a display region 514 of the liquid crystal element, a display region 515 of a light-emitting element corresponding to yellow, a display region 516 of a light-emitting element corresponding to green, a display region 517 of a light-emitting element corresponding to red, and a display region 518 of a light-emitting element corresponding to blue.

Note that in order to display black with high color reproducibility by using the light-emitting elements corresponding to green, blue, red, and yellow, the amount of current flowing to the light-emitting element corresponding to yellow per unit area needs to be the smallest among those flowing to the light-emitting elements. In FIG. 17B, the display region 516 of the light-emitting element corresponding to green, the display region 517 of the light-emitting element corresponding to red, and the display region 518 of the light-emitting element corresponding to blue have substantially the same area, and the display region 515 of the light-emitting element corresponding to yellow has a slightly smaller area than the other display regions. Therefore, black can be displayed with high color reproducibility.

This embodiment can be combined with any of the other embodiments as appropriate.

Embodiment 7

In this embodiment, examples of electronic devices that use the display device of one embodiment of the present invention will be described.

Figure 18A:
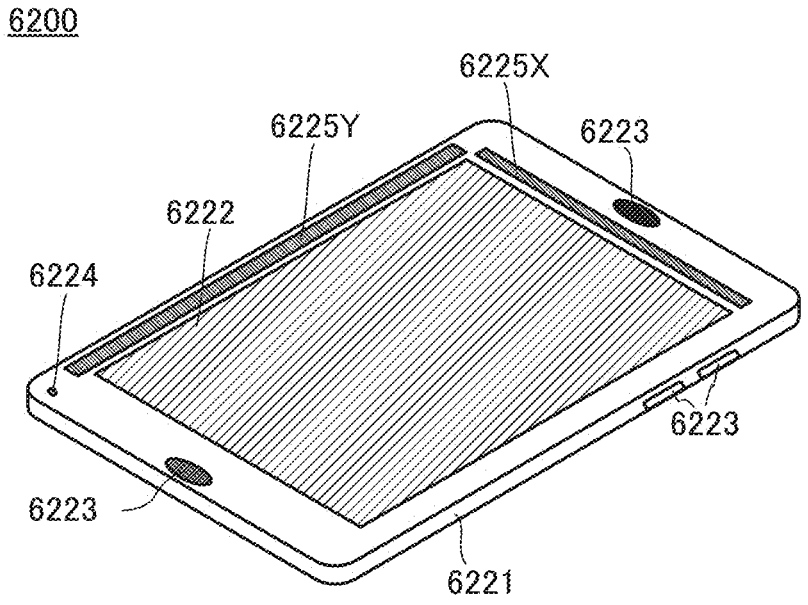
FIGS. 18A and 18B illustrate examples of an electronic device.

FIG. 18A illustrates an example of an electronic device that uses the display device of one embodiment of the present invention. FIG. 18A illustrates a tablet information terminal 6200, which includes a housing 6221, a display device 6222, operation buttons 6223, and a speaker 6224. A position input function may be added to the display device 6222 of one embodiment of the present invention. The position input function can be added by providing a touch panel in the display device. Alternatively, the position input function can be added by providing a photoelectric conversion element also called a photosensor in the pixel portion of the display device. As the operation buttons 6223, any one of a power switch for starting the information terminal 6200, a button for operating an application of the information terminal 6200, a volume control button, a switch for turning on or off the display device 6222, and the like can be provided. Although the number of the operation buttons 6223 is four in the information terminal 6200 illustrated in FIG. 18A, the number and position of operation buttons included in the information terminal 6200 are not limited to this example.

The information terminal 6200 includes an optical sensor 6225X and an optical sensor 6225Y for measuring the incident angle of external light. The optical sensor 6225X and the optical sensor 6225Y are located in a bezel of the housing 6221. Specifically, the optical sensor 6225X is located along one of two short sides of the bezel of the housing 6221, and the optical sensor 6225Y is located along one of two long sides of the bezel of the housing 6221. In one embodiment of the present invention, the incident angle and illuminance of external light are measured with the optical sensor 6225X and the optical sensor 6225Y. On the basis of the obtained data, the color and grayscale of an image to be displayed by the display device 6222 can be adjusted.

Figure 18B:
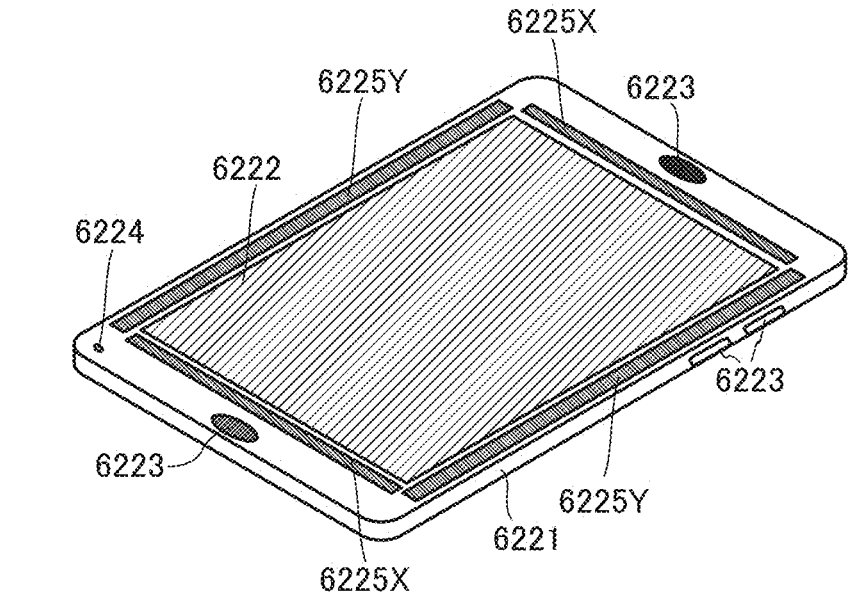

The locations of the optical sensor 6225X and the optical sensor 6225Y are not limited to those in the information terminal 6200 illustrated in FIG. 18A. For example, as in an information terminal 6201 illustrated in FIG. 18B, the optical sensor 6225X may be located along each of the two short sides of the bezel of the housing 6221, and the optical sensor 6225Y may be located along each of the two long sides of the bezel of the housing 6221.

Although not illustrated, the information terminal 6200 illustrated in FIG. 18A may include a sensor (which measures force, displacement, position, speed, acceleration, angular velocity, rotational frequency, distance, light, liquid, magnetism, temperature, a chemical substance, a sound, time, hardness, electric field, current, voltage, electric power, radiation, flow rate, humidity, gradient, oscillation, smell, infrared rays, or the like) inside the housing 6221. In particular, when a measuring device including a sensor such as a gyroscope sensor or an acceleration sensor for measuring inclination is provided, display on the screen of the display device 6222 can be automatically changed in accordance with the orientation of the information terminal 6200 illustrated in FIG. 18A by determining the orientation of the information terminal 6200 (the orientation of the information terminal with respect to the vertical direction).

A combination of information about the inclination with information about the incident angle and illuminance of external light which is obtained from the optical sensors 6225X and 6225Y described above enables more accurate adjustments of the color and grayscale of image data to be displayed by the display device 6222. In that case, with an imaging sensor provided in the housing 6221, information about the position of user's eyes (or viewing direction) with respect to the information terminal 6200 is obtained and combined with information about the inclination and the incident angle and illuminance of external light. This enables even more accurate adjustments of the color and grayscale of an image to be displayed by the display device 6222.

Although not illustrated, the information terminal 6200 illustrated in FIG. 18A may include a microphone and the speaker. With this structure, the information terminal 6200 can have a telephone function like a cellular phone, for example. Although not illustrated, the information terminal 6200 illustrated in FIG. 18A may include a camera. Although not illustrated, the information terminal 6200 illustrated in FIG. 18A may include a light-emitting device for use as a flashlight or a lighting device.

Although not illustrated, the information terminal 6200 illustrated in FIG. 18A may include a device for obtaining biological information such as fingerprints, veins, iris, voice prints, or the like. With this structure, the information terminal 6200 can have a biometric identification function.

Although not illustrated, the information terminal 6200 illustrated in FIG. 18A may include a microphone. In some cases, the information terminal 6200 can have a speech interpretation function. In some cases, the information terminal 6200 can have a speech interpretation function. With the speech interpretation function, the information terminal 6200 can have a function of operating the information terminal 6200 by speech recognition, a function of interpreting a speech or a conversation and creating a summary of the speech or the conversation, and the like. This can be utilized to create meeting minutes or the like, for example.

This embodiment can be combined with any of the other embodiments as appropriate.

Embodiment 8

FIGS. 19A to 19F each illustrate an example of an electronic device that uses the display device of one embodiment of the present invention.

Figure 19A:
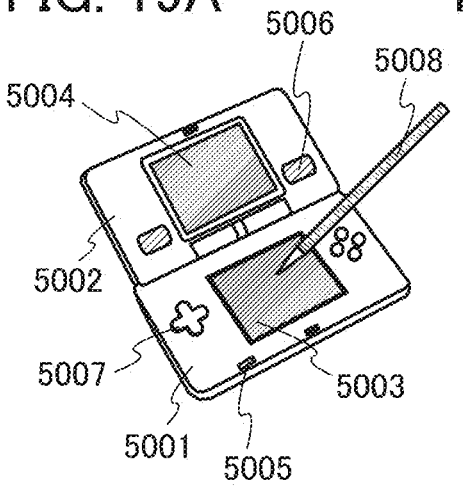
FIGS. 19A to 19F illustrate examples of electronic devices.

FIG. 19A illustrates a portable game machine including a housing 5001, a housing 5002, a display device 5003 of one embodiment of the present invention, a display device 5004 of one embodiment of the present invention, a microphone 5005, speakers 5006, operation keys 5007, a stylus 5008, and the like. Although the portable game machine in FIG. 19A has the two display devices 5003 and 5004, the number of display devices included in a portable game machine is not limited to this. When the display devices 5003 and 5004 each of which is one embodiment of the present invention are used in the portable game machine, the display devices 5003 and 5004 can display an image with high display quality without being influenced by the intensity of external light in an environment where they are used and can have lower power consumption.

Figure 19B:
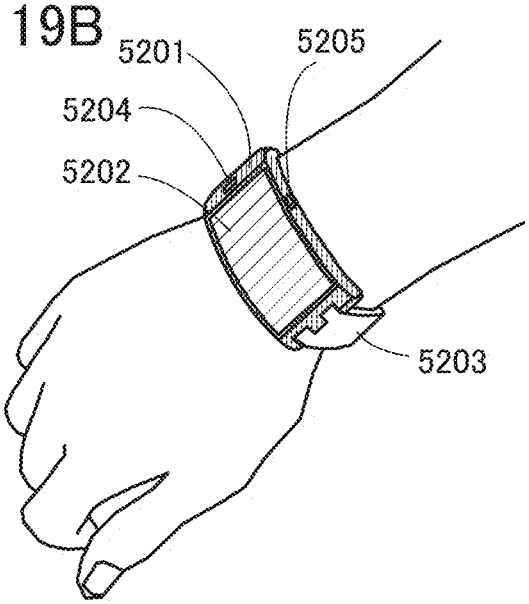

FIG. 19B illustrates a wristwatch-type portable information terminal including a housing 5201, a display device 5202 of one embodiment of the present invention, a band 5203, an optical sensor 5204, a switch 5205, and the like. When the display device 5202 of one embodiment of the present invention is used in the wristwatch-type portable information terminal, the display device 5202 can display a high-quality image regardless of the intensity of external light in an operating environment and achieve low power consumption.

Figure 19C:
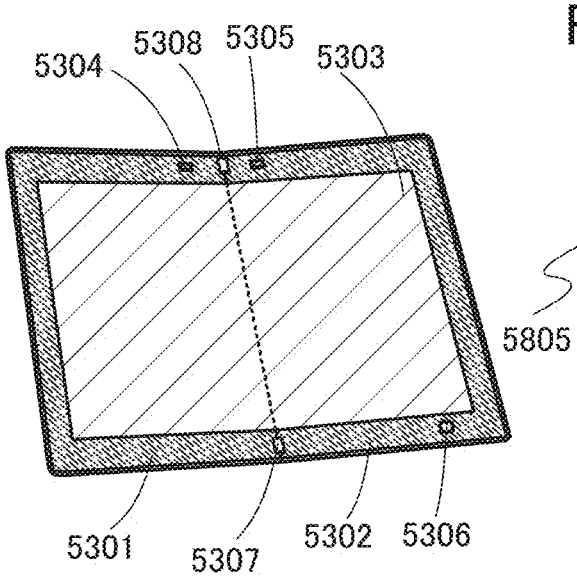

FIG. 19C illustrates a tablet personal computer including a housing 5301, a housing 5302, a display device 5303 of one embodiment of the present invention, an optical sensor 5304, an optical sensor 5305, a switch 5306, and the like. The display device 5303 is supported by the housing 5301 and the housing 5302. The display device 5303 is formed using a flexible substrate and therefore has a function of being flexible in shape and bendable. By changing the angle between the housing 5301 and the housing 5302 with a hinge 5307 and a hinge 5308, the display device 5303 can be folded such that the housing 5301 and the housing 5302 overlap with each other. Although not illustrated, an open/close sensor may be incorporated so that the above-described angle change can be used as information about conditions of use of the display device 5303. The optical sensor 5304 is provided on the housing 5301, and the optical sensor 5305 is provided on the housing 5302. With this structure, both information about the angle of incidence of external light on the display device 5303 in a region supported by the housing 5301 and information about the angle of incidence of external light on the display device 5303 in a region supported by the housing 5302 can be used as information about conditions of use of the display device 5303. When the display device 5303 of one embodiment of the present invention is used in the tablet personal computer, the display device 5303 can display a high-quality image regardless of the intensity of external light in an operating environment and achieve low power consumption.

Figure 19D:
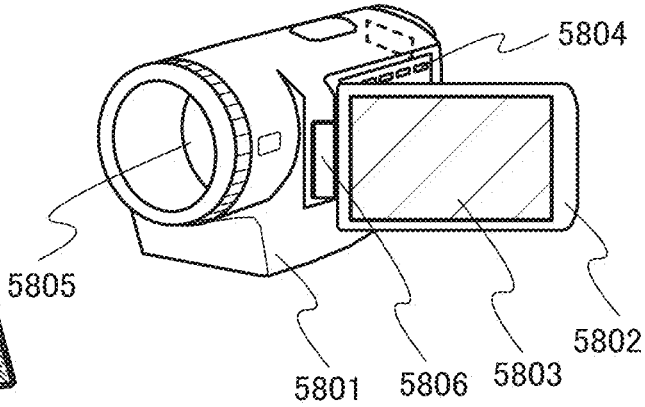

FIG. 19D illustrates a video camera, which includes a housing 5801, a housing 5802, a display device 5803 of one embodiment of the present invention, operation keys 5804, a lens 5805, a joint 5806, and the like. The operation keys 5804 and the lens 5805 are provided in the housing 5801, and the display device 5803 is provided in the housing 5802. The housing 5801 and the housing 5802 are connected to each other with the joint 5806, and the angle between the housing 5801 and the housing 5802 can be changed with the joint 5806. Images displayed on the display device 5803 may be switched in accordance with the angle at the joint 5806 between the housing 5801 and the housing 5802. When the display device 5803 of one embodiment of the present invention is used in the video camera the display device 5803 can display a high-quality image regardless of the intensity of external light in an operating environment and achieve low power consumption.

Figure 19E:
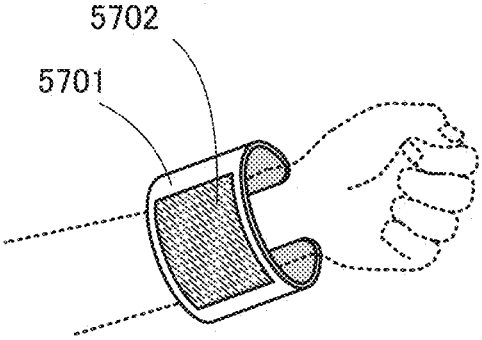

FIG. 19E illustrates a wristwatch-type portable information terminal including a housing 5701 having a curved surface, a display device 5702 of one embodiment of the present invention, and the like. When a flexible substrate is used for the display device 5702 of one embodiment of the present invention, the display device 5702 can be supported by the housing 5701 having a curved surface. Consequently, it is possible to provide a user-friendly wristwatch-type portable information terminal that is flexible and lightweight. In addition, when the display device 5702 of one embodiment of the present invention is used in the wristwatch-type portable information terminal, the display device 5702 can display a high-quality image regardless of the intensity of external light in an operating environment and achieve low power consumption.

Figure 19F:
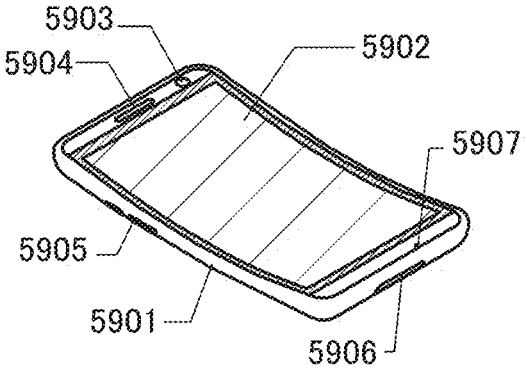

FIG. 19F illustrates a cellular phone including a display device 5902 of one embodiment of the present invention, a microphone 5907, a speaker 5904, a camera 5903, an external connection portion 5906, and an operation button 5905 in a housing 5901 having a curved surface. When the display device 5902 of one embodiment of the present invention is used in the cellular phone, the display device 5902 can display a high-quality image regardless of the intensity of external light in an operating environment and achieve low power consumption.

This embodiment can be combined with any of the other embodiments as appropriate.

This application is based on Japanese Patent Application Serial No. 2016-159795 filed with Japan Patent Office on Aug. 17, 2016, the entire contents of which are hereby incorporated by reference.

What is claimed is:

1. An operation method of a display device including a comparison circuit and a first display portion including a first pixel and a second pixel adjacent to the first pixel, wherein grayscale levels of an image displayed on the first display portion are $C_X$ at maximum, comprising:

writing a first image signal to the first display portion;

comparing the first image signal and a second image signal before the second image signal is written; and writing the second image signal, wherein a grayscale level of the first image signal written to one of the first pixel and the second pixel is higher than or equal to $0.8C_X$ and a grayscale level of the first image signal written to the other of the first pixel and the second pixel is lower than or equal to $0.2C_X$, wherein the writing of the second image signal is performed once when the grayscale levels of the second image signal written to the first pixel and the second pixel are each $0.8C_X$ or higher, or $0.2C_X$ or lower, wherein the writing of the second image signal is performed an odd number of times greater than or equal to three times when the grayscale levels of the second image signal written to the first pixel and the second pixel are each higher than $0.2C_X$ and lower than $0.8C_X$, and wherein an interval between the writing of the first image signal and the writing of the second image signal is longer than or equal to 1 second and shorter than or equal to 10,000 hours.

2. The operation method of a display device, according to claim 1, wherein the first display portion includes a first display element, wherein the first display element is configured to express a grayscale level by utilizing light reflection, wherein a second display portion is included in the display device, wherein the second display portion includes a pixel including a second display element, and wherein the second display element is a light-emitting display element.

3. The operation method of a display device according to claim 1, wherein each of the first pixel and the second pixel included in the first display portion includes a transistor, and wherein the transistor includes a metal oxide in a channel formation region.

4. An operation method of a display device including a comparison circuit and a first display portion including a first pixel and a second pixel adjacent to the first pixel, wherein grayscale levels of an image displayed on the first display portion are $C_X$ at maximum, comprising:

writing a first image signal to the first display portion;

comparing the first image signal and a second image signal before the second image signal is written; and writing the second image signal, wherein a grayscale level of the first image signal written to one of the first pixel and the second pixel is higher than or equal to $0.8C_X$ and a grayscale level of the first image signal written to the other of the first pixel and the second pixel is lower than or equal to $0.2C_X$, wherein the writing of the second image signal is performed once when the grayscale levels of the second image signal written to the first pixel and the second pixel are each $0.8C_X$ or higher, or $0.2C_X$ or lower, wherein the writing of the second image signal is performed an odd number of times greater than or equal to three times when the grayscale levels of the second image signal written to the first pixel and the second pixel are each higher than $0.2C_X$ and lower than $0.8C_X$, wherein an interval between the writing of the first image signal and the writing of the second image signal is longer than or equal to 1 second and shorter than or equal to 10,000 hours, wherein the first display portion includes a first display element, and wherein the first display element includes a, liquid crystal element.

5. The operation method of a display device, according to claim 4, wherein the first display element is configured to express a grayscale level by utilizing light reflection, wherein a second display portion is included in the display device, wherein the second display portion includes a pixel including a second display element, and wherein the second display element is a light-emitting display element.

6. The operation method of a display device according to claim 4, wherein each of the first pixel and the second pixel included in the first display portion includes a transistor, and wherein the transistor includes a metal oxide in a channel formation region.

* * * * *